US007458360B2

(12) United States Patent
Irihune et al.

(10) Patent No.: US 7,458,360 B2
(45) **Date of Patent: *Dec. 2, 2008**

(54) MOTOR DRIVING TYPE THROTTLE APPARATUS

(75) Inventors: Kazunori Irihune, Hitachinaka (JP); Yasushi Sasaki, Naka (JP); Sadayuki Aoki, Takanagi (JP); Kazuo Nagayama, Hitachinaka (JP); Yuuichi Ebata, Hitachiohta (JP)

(73) Assignees: Hitachi, Ltd., Tokyo (JP); Hitachi Car Engineering Co., Ltd., Hitachinaka-shi (JP)

( * ) Notice: Subject to any disclaimer, the term of this patent is extended or adjusted under 35 U.S.C. 154(b) by 152 days.

This patent is subject to a terminal disclaimer.

(21) Appl. No.: 11/431,015

(22) Filed: May 10, 2006

(65) Prior Publication Data

US 2006/0266329 A1 Nov. 30, 2006

Related U.S. Application Data

(60) Division of application No. 10/731,132, filed on Dec. 10, 2003, now Pat. No. 7,284,535, which is a continuation of application No. 09/890,704, filed as application No. PCT/JP00/00671 on Feb. 8, 2000, now Pat. No. 6,725,833.

(30) Foreign Application Priority Data

Mar. 29, 1999 (JP) ..... 11-086859

(51) Int. Cl.
*F02D 9/08* (2006.01)
*F02D 41/00* (2006.01)

(52) U.S. Cl. ..... 123/337; 123/360; 123/376

(58) Field of Classification Search ..... 123/360, 123/361, 339.1, 339.13, 339.25, 337, 376, 123/398

See application file for complete search history.

(56) References Cited

U.S. PATENT DOCUMENTS 4,604,976 A 8/1986 Sturdy (Continued)

FOREIGN PATENT DOCUMENTS

DE 4108735 9/1992

(Continued)

*Primary Examiner*—John T Kwon
(74) *Attorney, Agent, or Firm*—Crowell & Moring LLP

(57) ABSTRACT

An throttle valve is controlled by using an electric actuator. A cover for covering one end side of the throttle valve shaft is attached to a side wall of a throttle body. a throttle position sensor unit and an electronic control module for controlling the throttle valve is attached to an inner face of the cover. The throttle position sensor and the electronic control module are contiguous to each other and connected at a position contiguous thereto. The cover is provided with a connector portion for external connection of the electronic control module. A group of lead frames constituting terminals of the connector portion are embedded in the cover. Power source is supplied to a motor via the connector portion for external connection, the electronic control module and intermediary connectors provided at the cover. Thereby, by simplifying the cover for protecting the throttle valve. The motor as a drive source and a power transmission apparatus, electric connection lines and connecting portions are integrally assembled. Thereby a motor driving type throttle apparatus can be integrated to an engine by inexpensive fabrication cost, in a compact and simple style and with high reliability.

4 Claims, 22 Drawing Sheets

U.S. PATENT DOCUMENTS

| | | | | | |
|---|---|---|---|---|---|
| 4,875,351 | A | * | 10/1989 | Evans et al. | 70/271 |
| 5,055,781 | A | | 10/1991 | Sakakibara et al. | |
| 5,691,584 | A | * | 11/1997 | Toida et al. | 310/67 R |
| 5,711,271 | A | | 1/1998 | Schlagmueller et al. | |
| 5,718,202 | A | * | 2/1998 | Bentz et al. | 123/399 |
| 5,901,801 | A | * | 5/1999 | Toida et al. | 180/65.1 |
| 6,067,958 | A | | 5/2000 | Kamimura et al. | |
| 6,240,899 | B1 | * | 6/2001 | Yamada et al. | 123/396 |
| 6,279,535 | B1 | | 8/2001 | Matsusaka | |
| 6,341,593 | B2 | | 1/2002 | Kamimura et al. | |
| 6,407,543 | B1 | | 6/2002 | Hagio et al. | |
| 6,582,260 | B2 | | 6/2003 | Nemoto et al. | |
| 6,725,833 | B1 | * | 4/2004 | Irihune et al. | 123/399 |
| 7,284,535 | B2 | * | 10/2007 | Irihune et al. | 123/337 |

FOREIGN PATENT DOCUMENTS

| | | |
|---|---|---|
| DE | 19713838 | 10/1998 |
| DE | 19811867 | 10/1998 |
| DE | 19811869 | 10/1998 |
| DE | 19820421 | 11/1998 |
| EP | 0596392 | 5/1994 |
| EP | 0989291 | 3/2000 |
| EP | 0989292 | 3/2000 |
| EP | 0989293 | 3/2000 |
| JP | 01-315629 | 12/1989 |
| JP | 4066736 | 3/1992 |
| JP | 04-252829 | 9/1992 |
| JP | 05-231894 | 9/1993 |
| JP | 08-254129 | 10/1996 |
| JP | 09-303164 | 11/1997 |
| JP | 10-306735 | 11/1998 |
| JP | 11-044265 | 2/1999 |
| JP | 11-132707 | 5/1999 |

* cited by examiner

MOTOR DRIVING TYPE THROTTLE APPARATUS

BACKGROUND OF THE INVENTION

Field of the Invention

The present invention relates to a motor driving type throttle apparatus.

Conventionally, a motor driving type throttle apparatus which drives a throttle valve of an internal-combustion engine by an electronic actuator (for example, direct current motor, stepping motor) has been put to practical use.

A motor driving type throttle apparatus is electronically controlled based on opening degree signal of accelerator pedal or traction control signal, and drives the throttle to make an optimum throttle position (throttle valve opening degree) in accordance with an engine state. For that purpose, a throttle position sensor for detecting the throttle position (opening degree of the throttle valve) is attached to the throttle body.

Further, the motor driving type throttle apparatus is integrally assembled with an electronic control module, there is disclosed Japanese Translation of Unexamined PCT Application No. 508954/1997.

According to the application, a number of individual members provided to an electronic type engine control system are attached to a sleeve (throttle body) of a throttle apparatus.

It is described that there are provided for example at least one throttle mechanism operable by a throttle valve driving motor (electric actuator), an electronic controller and a regenerating valve and/or an air flow sensor. These members are contained in a common casing as a pre-assembled constitution unit.

SUMMARY OF THE INVENTION

It is an object of the invention to provide a compact motor driving type throttle apparatus capable of being assembled to an engine with high reliability in a simple style, in which manufacturing cost is inexpensive by simplifying various members generally used conventionally, for example, a cover, electric connection lines and connected portions and so on which are separately provided to a throttle valve, a motor as a drive source, a power transmission apparatus and the like.

Further, the invention provides a motor driving type throttle apparatus facilitating to arrange an electronic control module and capable of saving space of the formation.

The present invention proposes the following throttle apparatus in order to achieve the above-described object.

(1) There is proposed a motor driving type throttle apparatus constituted by integrating an electronic control module to said throttle apparatus, in which the apparatus is integrally formed with a cover for protecting a throttle actuator (for example, throttle valve driving motor) and a power transmission apparatus (for example, gear mechanism) and an electronic module housing.

For example, there is proposed a motor driving type throttle apparatus characterized by comprising a throttle body integrally formed with throttle valve housing and a throttle actuator housing;

wherein a power transmission apparatus for transmitting an output of the throttle actuator to the throttle valve is integrated to the throttle body;

wherein an electronic control module for controlling the throttle valve is contained in a module housing or mounted on a board; and wherein the throttle actuator and the power transmission apparatus are arranged to be protected by a single cover. Said cover and said module housing or said board are integrally formed.

There may be constituted an apparatus in which the electronic control module serves as the cover.

(2) There is proposed a throttle apparatus in which a throttle position sensor is integrally assembled to the cover formed by an insulating material (the assembling may be carried out by integrating parts of the throttle position sensor directly to the cover, or carried out by a unit style by integrating an assembly, that is, an throttle sensor unit assembled at a preceding step), electric conductors are integrally insert-molded into the cover, and the throttle position sensor and an electronic control module are electrically connected via the conductor.

(3) Further, there is proposed a throttle apparatus in which when the throttle position sensor and the cover are separately formed (throttle position sensor is unitized before being integrated to the cover), the throttle position sensor unit is integrated to the cover by thermal fastening.

(4) Further, the throttle position sensor and the conductor may be connected by wire bonding or welding, and intermediary terminals may be provided between the throttle position sensor and the conductor.

(5) Further, there is proposed an apparatus in which a throttle actuator and a electronic control module are electrically connected via a conductor insert-molded integrally into the cover formed by the insulating material.

In this case, the throttle actuator and the conductor are connected by wire bonding or welding.

Intermediary terminals may be provided between the throttle actuator and the conductor.

(6) Further, an air flow meter may be integrated to the electronic control module. Thereby, there can be achieved no adjustment formation of output of the air flow meter by learning by a microcomputer.

For example, the apparatus is characterized in which a cover for protecting the throttle actuator with the power transmission apparatus and a module housing for containing an electronic control module for controlling the throttle valve are integrally formed;

wherein a board is bonded to the module housing, and the electronic control module is mounted to the board; and wherein an air flow meter is integrated to the module housing, and the electronic control module is disposed on an upper side of the air flow meter.

(7) Further, there is proposed a constitution in which the electronic control module is arranged in an orthogonal direction to the air flow meter housing.

The present invention proposes the following other constitution.

(8) There is provided a motor driving type throttle apparatus characterized in which a cover for covering one end side of a throttle valve shaft is attached to a side wall of a throttle body having a throttle valve, and an electronic control module for controlling the throttle valve is attached to the cover.

(9) Further, there is provided the throttle apparatus in which an inner face of the cover is attached with an electronic control module for controlling the throttle valve and a throttle position sensor for detecting a position (opening degree) of the throttle valve contiguous to each other. The terminals of the throttle position sensor are directed to a side of the electronic control module, and connected with terminals of the electronic control module.

(10) Further, there is proposed a throttle apparatus in which an inner face of said cover is formed with a throttle position sensor housing and an electronic control module housing and an intermediary connector for connecting to motor terminals of the electric actuator. An outer face of the cover is formed with a connector for external connection of the electronic control module.

(11) Further, in relation thereto, there is proposed a throttle apparatus in which the throttle position sensor and the electronic control module integrally attached to the inner face of said cover. The throttle position sensor and the electronic control module are contiguous to each other and connected. The connector for external connection of the electronic control module is mounted at said cover, ends on one side of a group of lead frames constituting terminals of the connector are arranged to align along one side of an inner side of the cover and connected to a group of terminals provided at a circuit board of the electronic control module;

wherein power source is supplied to the electric actuator via a connector for external connection and intermediary connectors. Said intermediary are provided at the electronic control module and the cover.

(12) Further, with regard to the intermediary connectors, there is proposed a constitution in which an intermediary terminal housing for containing the intermediary terminals formed with the cover by integral molding, and the intermediary terminals are arranged there.

(13) Terminals of the throttle position sensor and conductors for electric wiring are connected, the conductors and terminals of the electronic control module are connected by, for example, wire bonding or welding.

(14) Further, there is proposed the following constitution as a motor driving type throttle apparatus in consideration of heat radiating performance.

For example, a resin cover for covering one end side of the throttle valve shaft is attached to a side wall of the throttle body, and an electronic control module for controlling a throttle valve is attached to an inner face of said resin cover;

wherein the electronic control module has a circuit board for control and a plate formed by an excellent thermally conductive material (for example, made of aluminum) for holding the circuit board and a module cover formed by an excellent thermally conductive material for covering the circuit board on the plate. The plate and the module cover are brought into contact with each other via a thermally conductive member and the module cover is brought into contact with the throttle body formed by an excellent thermally conductive material via a thermally conductive member.

DESCRIPTION OF THE PREFERRED EMBODIMENTS

Figure 1:
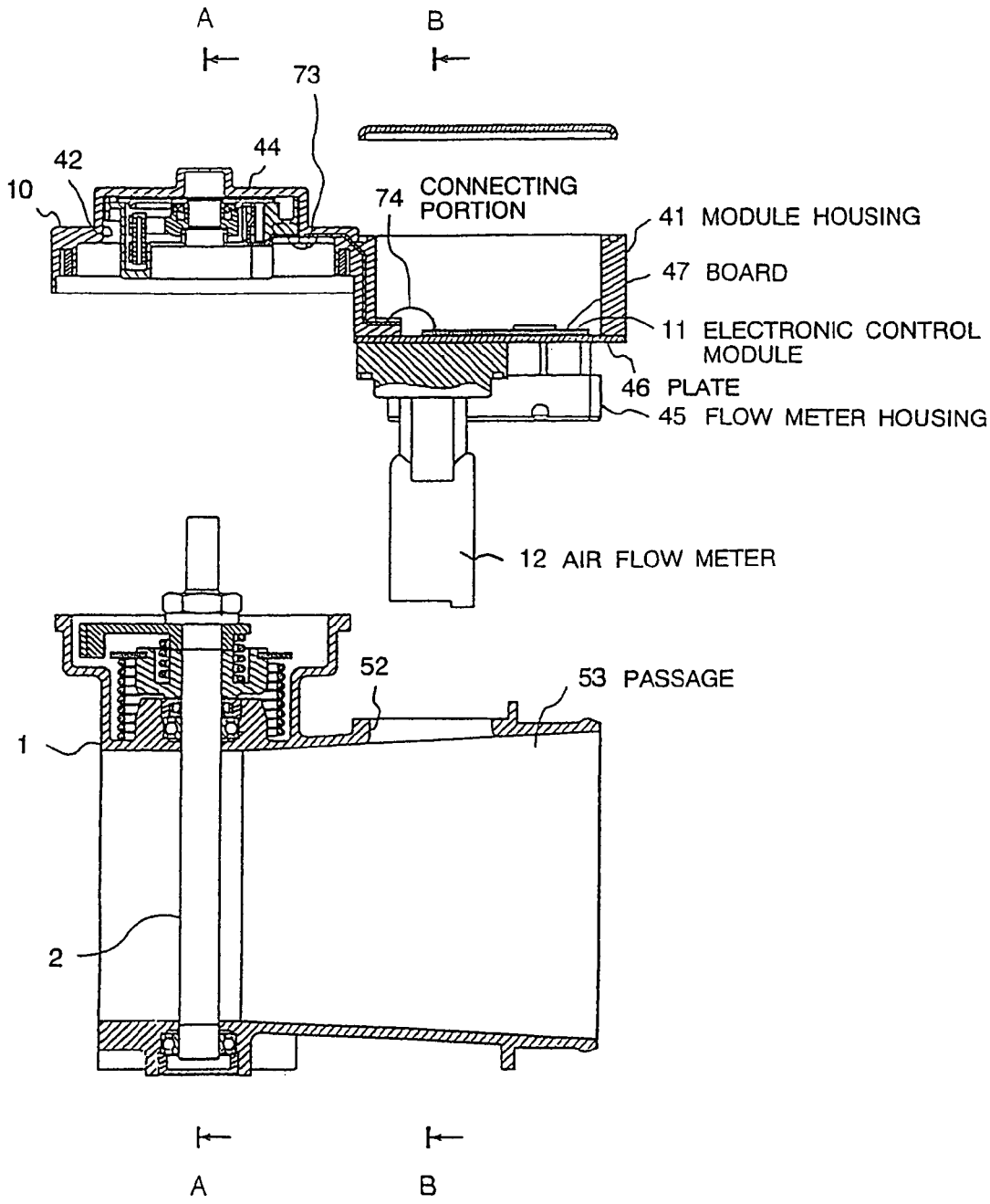
FIG. 1 is a vertical sectional view showing parts assembling of a throttle apparatus according to a first embodiment of the invention.
Figure 2:
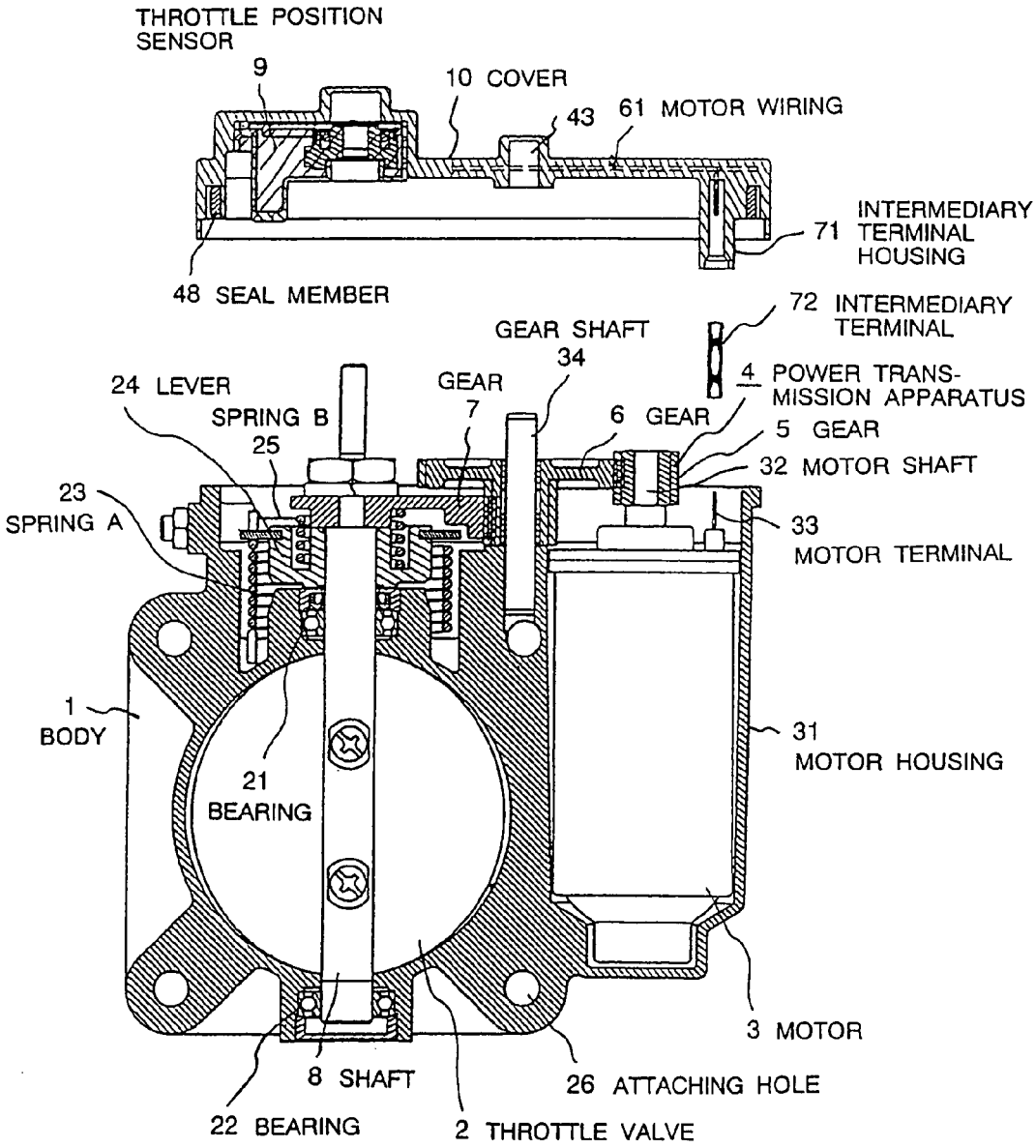
FIG. 2 is a sectional view taken along a line A-A of FIG. 1.
Figure 3:
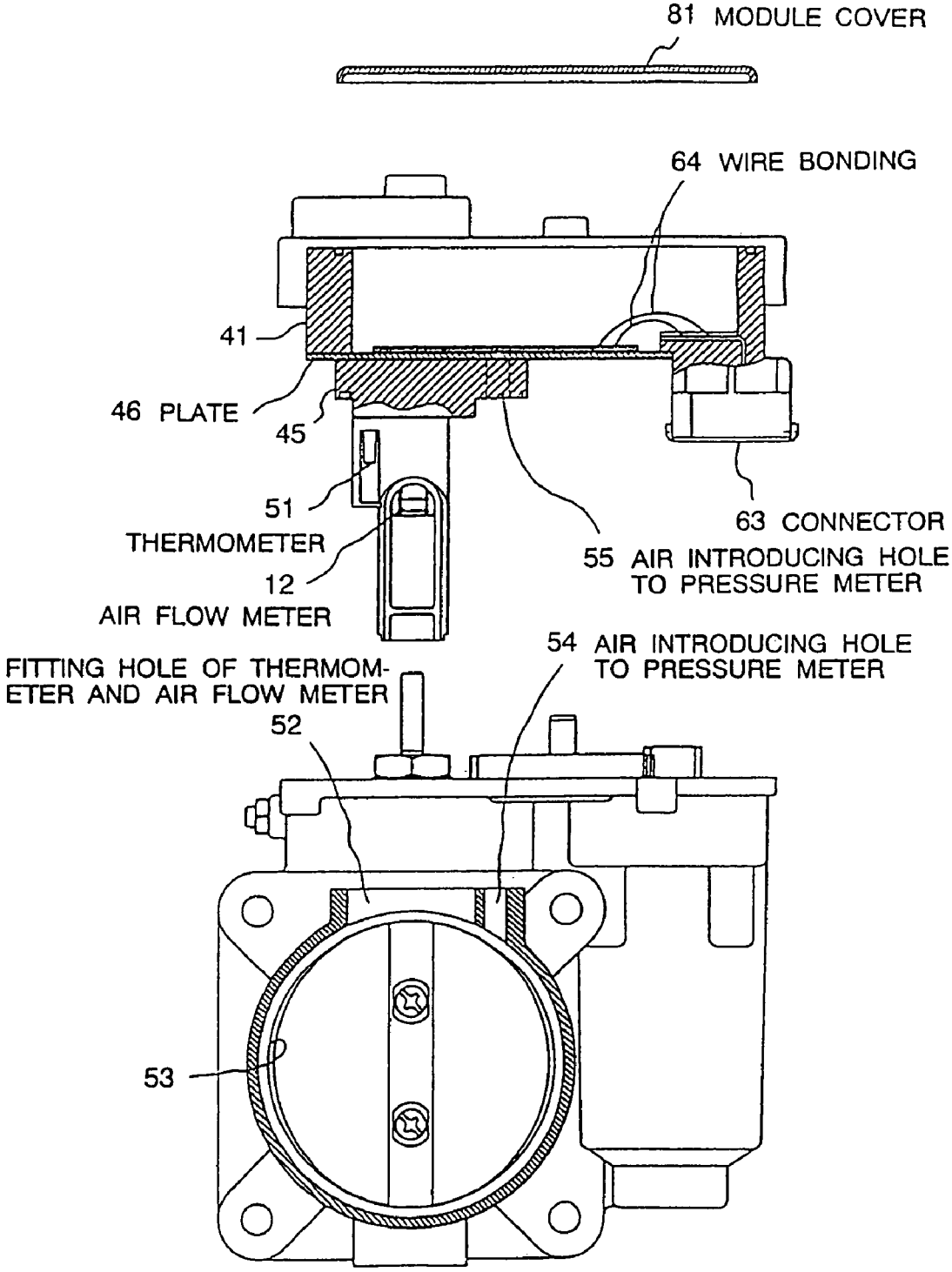
FIG. 3 is a sectional view taken along a line B-B of FIG. 1.
Figure 4:
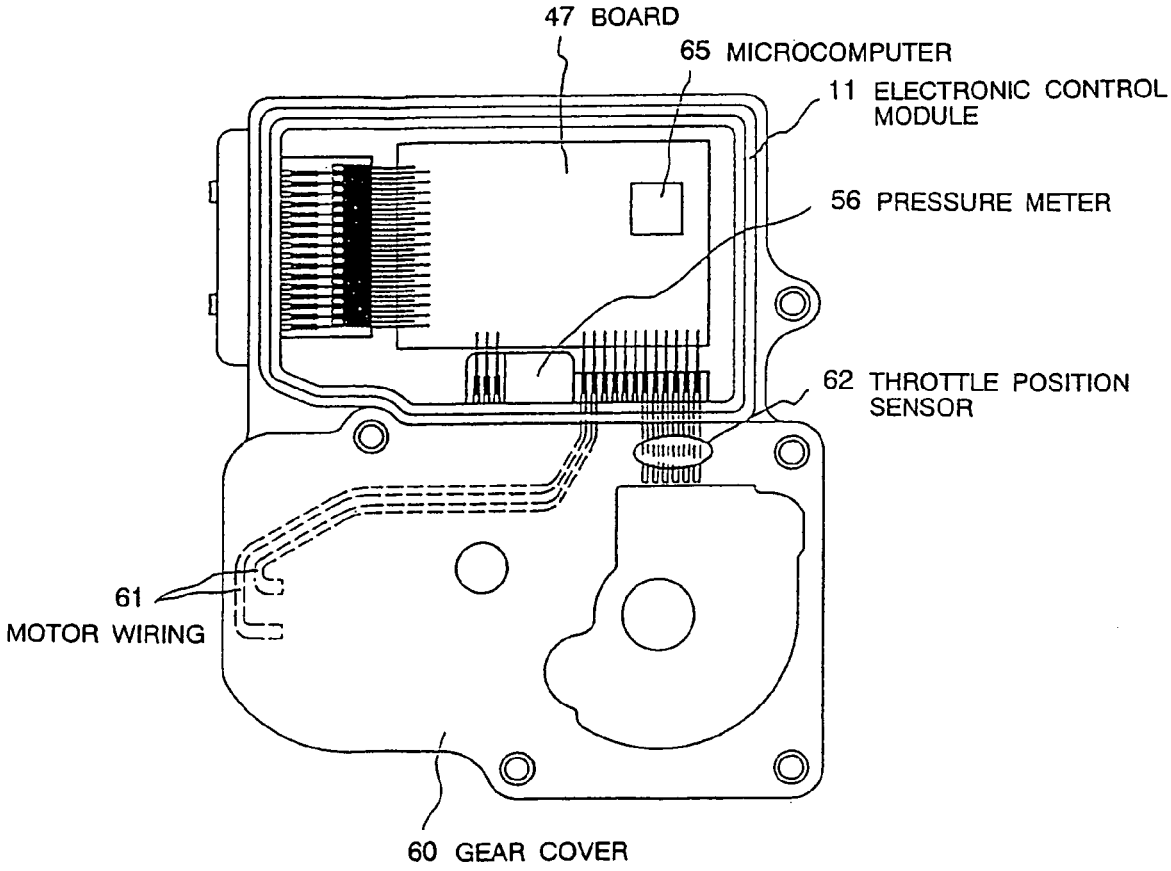
FIG. 4 is a plane view of FIG. 1.
Figure 5:
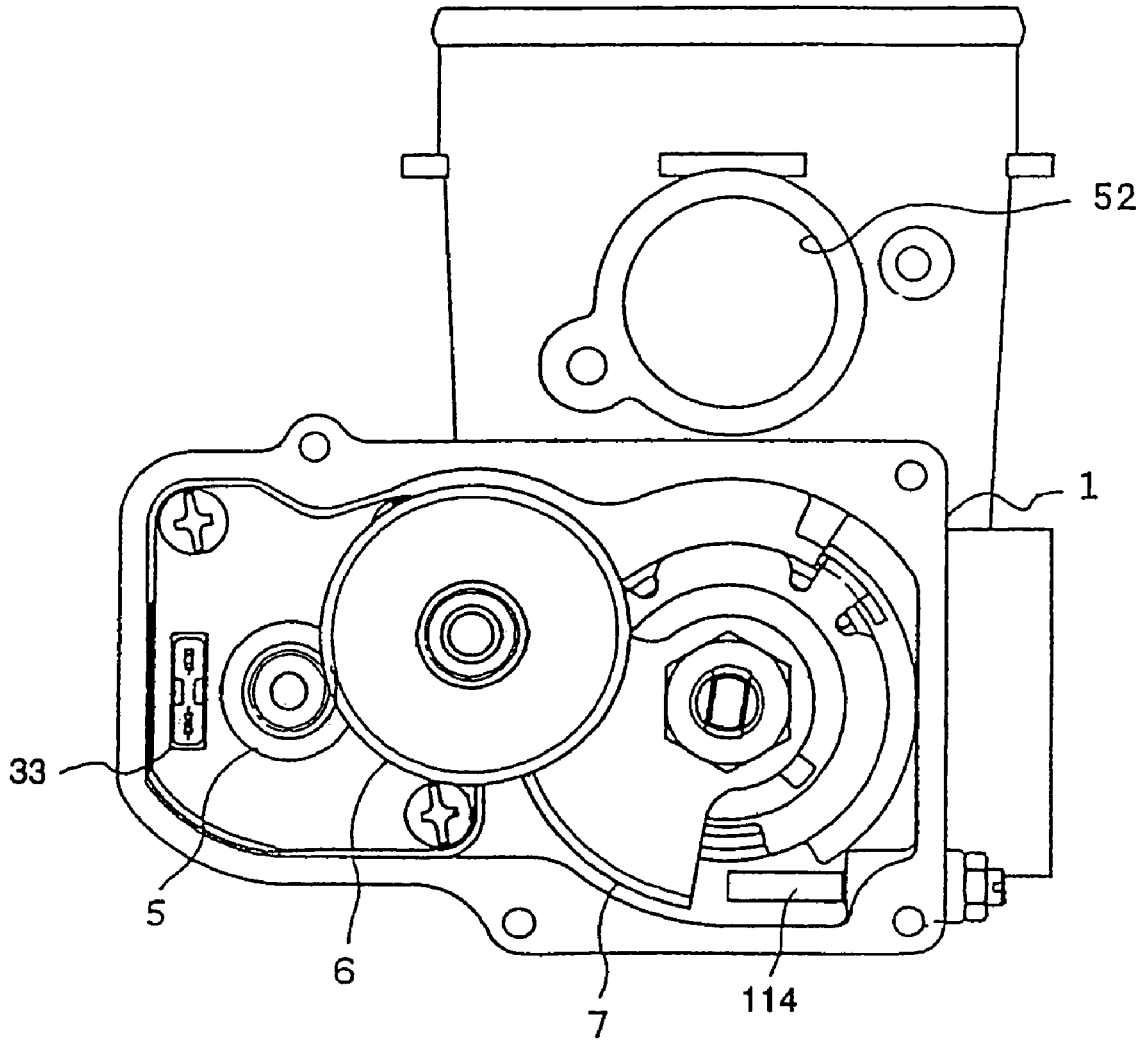
FIG. 5 is a sectional view of FIG. 1.
Figure 6:
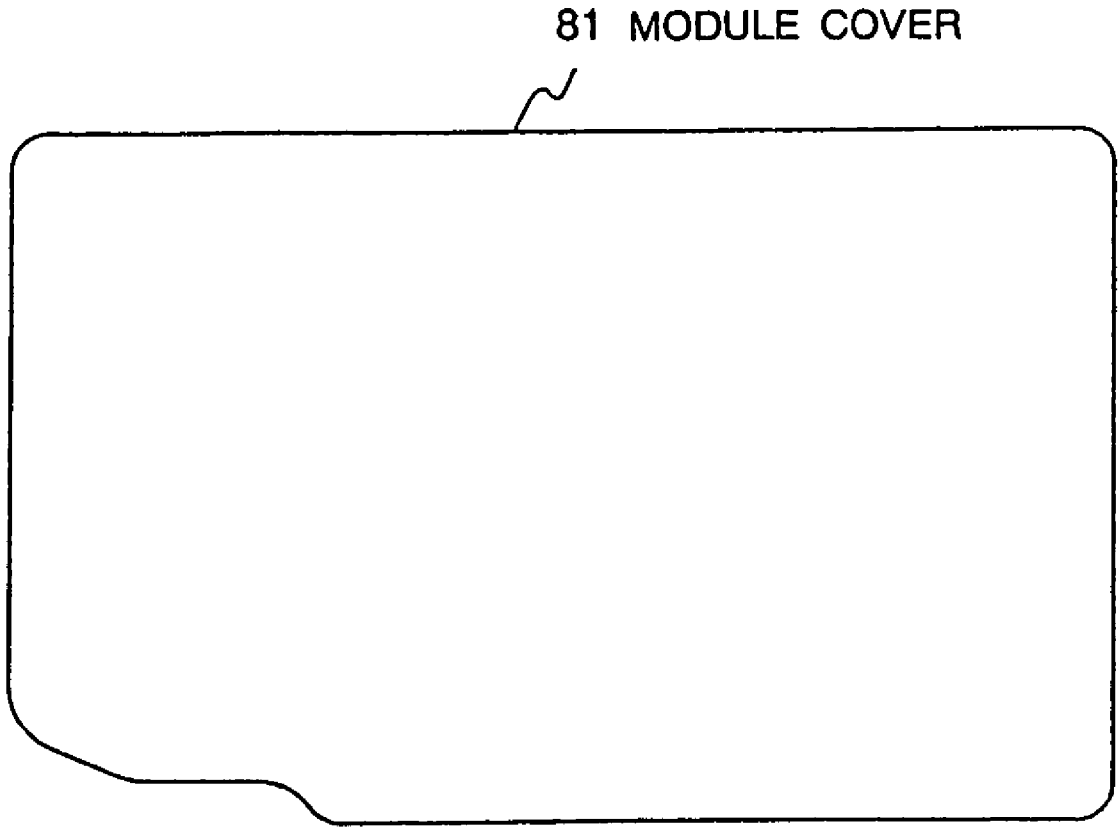
FIG. 6 is a plane view showing a module cover.

An explanation will be given of an embodiment according to the invention in reference to the drawings as follows.

In these FIGS. 1~FIG. 5, a motor driving type throttle apparatus (throttle valve apparatus) is constituted by, as main elements, a throttle body (hereinafter, may simply be referred to as body) 1, a throttle valve 2, a motor 3 (throttle actuator) for driving the throttle valve 2, a power transmission apparatus 4, a throttle position sensor (throttle valve opening degree meter) 9 provided at a throttle valve shaft 8 for measuring a position of throttle valve 12 (opening degree of the throttle valve 2), a cover 10 for protecting the throttle valve 2•the motors 3•the power transmission apparatus 4, an electronic control module 11 and an air flow meter 12.

The body 1 is constituted by integrally molding a containing portion of the throttle valve 2 (throttle housing or throttle chamber) and a containing portion (motor housing) 31 of the motor 3. The motor 3 may externally be attached integrally. Therefore, here, the portion is represented as the 'containing ' portion including such a mode.

The throttle valve 2 is provided at an inner portion (air passage) of the body 1, the shaft 8 is supported by bearings 21 and 22 provided at the body 1, and one end portion of the shaft 8 is projected to outside of the body.

Further, the projecting portion of the shaft 8 is guided by a spring A23, a lever 24, a spring B25.

Further, the body 1 is provided with 4 pieces of attaching holes 26. The structure is well known and further explanation is not needed.

The body 1 contains the motor 3 by the motor housing 31. An axial direction of the motor 3 coincides with a direction of the throttle valve shaft 8, and a motor shaft 32 is provided with a gear 5. Further, the motor 3 is provided with a motor terminal 33.

The body 1 is provided with a gear shaft 34 in a direction the same as the direction of the shaft 8, and a gear 6 is rotatably fixed thereto. Further, a gear 7 is disposed on a lower side of a gear. At an upper end of the lever 24, the shaft 8 is provided with the gear 7, the gear 5 and the gear 6 mesh together, the gear 6 and the gear 7 mesh together in the illustrated style, thereby these gears constitute the power transmission apparatus 4. The throttle valve 2 can be operated to open and close in a decelerated state with the motor 3 (a drive source) by said transmission.

In this way, the power transmission apparatus 4 for transmitting an output of the throttle actuator to the throttle valve 2, is integrally assembled to the body 1.

The cover 10 for protecting the throttle valve 2, the throttle actuator (motor 3) and the power transmission apparatus (gear mechanism) 4, is integrally molded by resin. In this case, a module housing 41 for containing the electronic control module 11 for controlling motor 3 is integrally molded along with the cover 10.

The cover 10 is integrally molded with a throttle position sensor housing 42, and a gear shaft housing. THE housing 42 contains the throttle position sensor 9 attached to the one end of the shaft 8. A gear shaft housing contains one end of the gear shaft 34. A throttle valve protecting cover portion 44 and the module housing 41 are molded with a difference in level as illustrated.

When the throttle position sensor 9 and the cover 10 are separately molded by resin. And thereafter, the throttle position sensor 9 is fixed to the cover 10 by thermal tightening.

As the air flow meter 12, there are known various flow rate meters, although the flow meter is not specified, for example, a hot wire type air flow meter can be adopted.

The air flow meter 12 is fixedly attached to a plate 46 constituted by aluminum or the like via a flow meter housing 45. A circuit board 47 of the electronic control module 11 is mounted on the plate 46. The plate 46 is adhered to the module housing 41. According to the embodiment, the module housing 41 and the plate 46 for mounting the board 47 are separately molded, and thereafter these are integrated. But as other molding method, the module housing 41 and the plate 46 can integrally be molded. In the former case (module housing 41 and the plate 46 are separately molded), the assembling is easy in view of steps of mounting and adhering the electronic control module 11 onto the board. In latter case (the module housing 41 and the plate 46 are integrally molded), a number of parts can be reduced. Any of these may be adopted in accordance with design.

As illustrated, the module housing 41 is disposed above the flow meter 12, the electronic control module 11 is arranged in a horizontal direction relative to a direction of a flow passage 53 of the throttle body 1. In this way, the assembling parts is facilitated. Further, by lowering the module housing 41 relative to the throttle valve protecting cover portion 44 and bringing the module housing 41 near to the air flow meter 12 (throttle body 2), it is effective for protecting the electronic control module 11 against external force such as that in dropping or the like. The cover 10 is provided with a seal member 48 constituted By rubber or the like to direct to the body 1 at the surrounding.

The flow meter housing 45 is provided with a thermometer 51. The thermometer 51 and the flow meter 12 are arranged in the flow passage 53 via a fitting hole 52 provided at the body 1.

Further, the body 1 is provided with an air introducing hole 54 conducted to a pressure meter 56 to communicate with an air introducing hole 55 provided at the flow meter housing 45. Pressure of the flow passage 53 is measured by the pressure meter 56 which is provided at the electronic control module 11.

In this way, the electronic control module 11 is integrated with the flow meter 12, the thermometer 51 and the pressure meter 56.

According to such a constitution, by integrating the flow meter to the electronic control module, no adjustment formation of flow meter output can be achieved by learning by a microcomputer, further, by omitting harness and connector, there can be achieved 1) low cost formation, 2) promotion of reliability, 3) space saving formation, 4) connector aggregation and 5) assembly simplification.

In molding a gear cover 60 of the cover 10, motor wiring 61 and wiring 62 for the throttle position sensor 9, as conductors, are integrally molded and integrated to inner portions of the cover.

The gear cover 60 is formed with an intermediate terminal housing 71, and an intermediate terminal 72 is contained therein. Thereby, a motor terminal 33 is electrically connected to the motor wiring 61 via the intermediate terminal 72. The throttle position sensor 9 and its wiring 62 (conductor) are bonded by wire bonding or welded by way of an intermediate terminal, or directly not by way of the intermediate terminal. Further, the same goes with between the wiring 62 and the electronic control module 11. Connecting portions of these are designated by numerals 73 and 74.

The throttle actuator (motor) 3 and the electronic control module 11 are electrically connected by the motor wiring 61 (conductor) which integrally embedded in the cover 10 molded by insulating material. The throttle actuator and the motor wiring 61 are electrically connected via the intermediate terminal 72. A connecting portion between a connector 63 and the electronic control module 11 connected by wire bonding or welding, is designated by numeral 64.

In this way, the board 47 is connected to the motor wiring 61 and the throttle position sensor wiring 62. A microcomputer 65 is arranged on the board 47. The module housing 41 is covered by a module cover 81 to thereby protect the electronic control module 11.

Next, an explanation will be given of a second embodiment of the invention in reference to FIG. 7 through FIG. 20.

Figure 7:
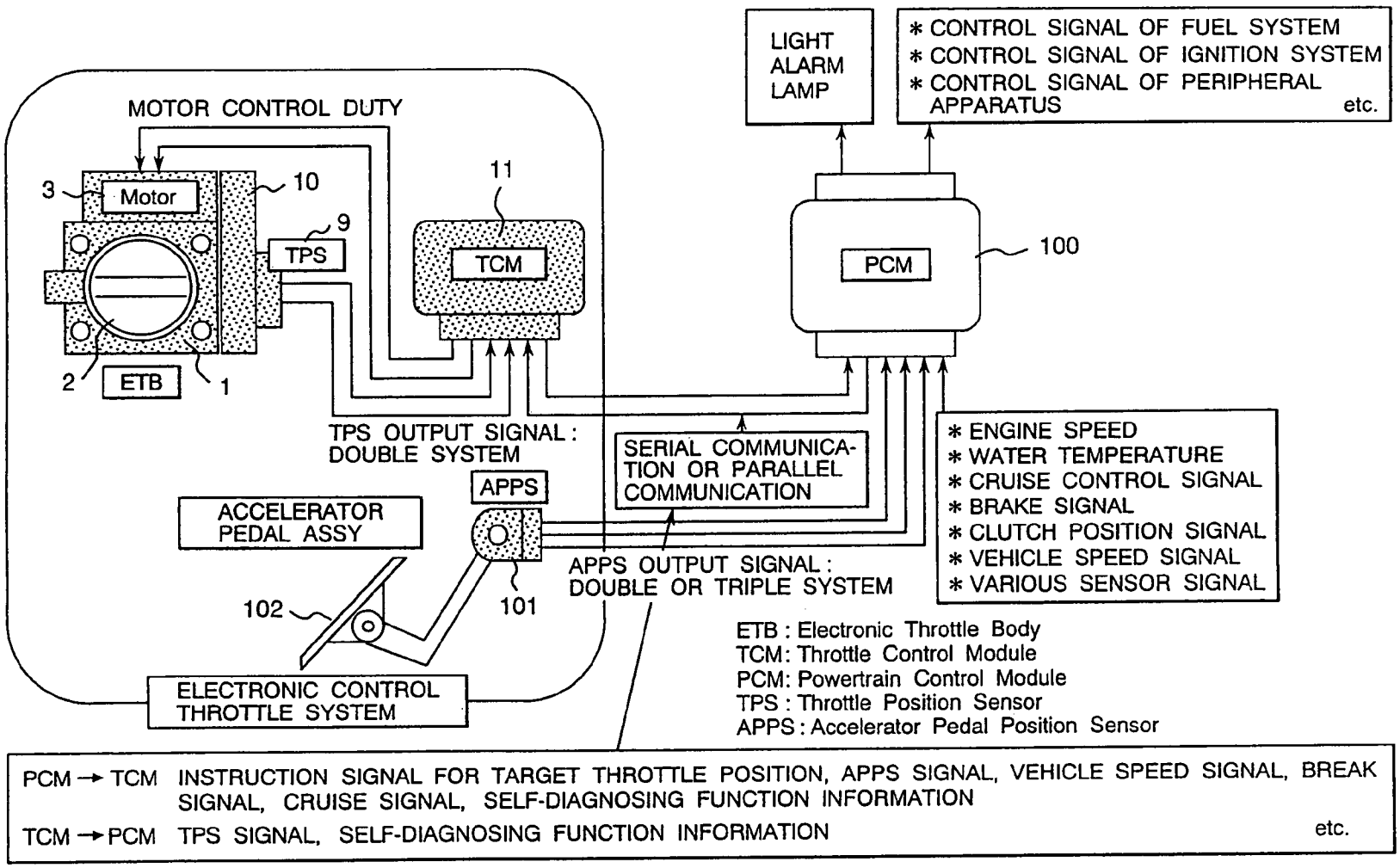
FIG. 7 is a constitution diagram of an engine control system constituting an object of applying the invention.

FIG. 7 is a constitution diagram of an engine control system to which the motor driving type throttle apparatus according to the embodiment is applied (the system is applied also to the first embodiment), first, an explanation will be given of the system constitution.

According to the engine control system of FIG. 7, a module of the engine control system is divided by a plural number in order to alleviate burden. For example, the module is divided into a power train control module (hereinafter, Powertrain Control Module is abbreviated and referred to as PCM) 100 constituting a central engine control unit and the electronic control module (here, may be referred to as TCM by abbreviating Throttle Control Module) 11 for controlling the throttle valve as has been described already. PCM 100 inputs various sensor signals of engine rotation number, water temperature, cruise control signal, brake signal, clutch position signal, vehicle speed sensor signal. And PCM 100 calculates a fuel system control signal, an ignition system control signal and a peripheral apparatus control signal.

Further, PCM 100 inputs a position signal of an accelerator pedal 102 from a accelerator pedal position sensor (hereinafter, in this case, Accelerator Pedal Position Sensor is abbreviated and is referred to as APPS) 101.

PCM 100 calculates target instruction throttle position signal (target opening degree signal of the throttle valve) based on the vehicle speed signal and the like. PCM 100 transmits said accelerator position signal and said target instruction signal to TCM 11 by serial communication or parallel communication.

TCM 11 inputs the target opening degree instruction signal and an really opening degree signal of the throttle position sensor (Throttle Position Sensor may be abbreviated and referred to as TPS) 9, and controls the motor 3 by duty control such that the throttle valve 2 is provided with the set opening degree.

Other than these, TCM 11 inputs the APPS signal, the vehicle speed signal, the break signal, the cruise signal and so on via PCM 100. And TCM11 self-diagnoses whether the throttle control system is abnormal in view of relationships between these signals and the TPS signal.

PCM 100 is also inputs the TPS signal (throttle valve opening degree signal) from TCM 11, and self-diagnoses whether normal control operation is carried out based thereon.

Further, the fail-safe is achieved by transmitting information of the above self-diagnosing, mentioned above, to counterpart sides (monitoring PCM and TCM by each other).

Conventional TCM 11 is provided integrally with APPS 101, for example, on the side of the accelerator pedal system in consideration of temperature environment, influence of space or the like. According to the embodiment, by carrying out improvements with regard to heat resistance, heat radiating performance and small-sized formation, TCM is made attachable to the throttle body, particularly, TCM (electronic control module) 11 is made attachable to a cover (for example, gear cover) attached to the throttle body.

Here, with respect to the TPS signal (throttle valve opening degree signal), a spare can be arranged in consideration of accidental failure. Therefore, the TPS is constituted by sensors of a so-to-speak double system which prepares two sensors of the same type in one package. Also with regard to APPS, it is constituted by a double or triple system.

Next, an explanation will be given of a throttle apparatus according to the embodiment. Further, in the drawings, parts the same as those in the embodiment described above, indicate the same or common elements.

Figure 8:
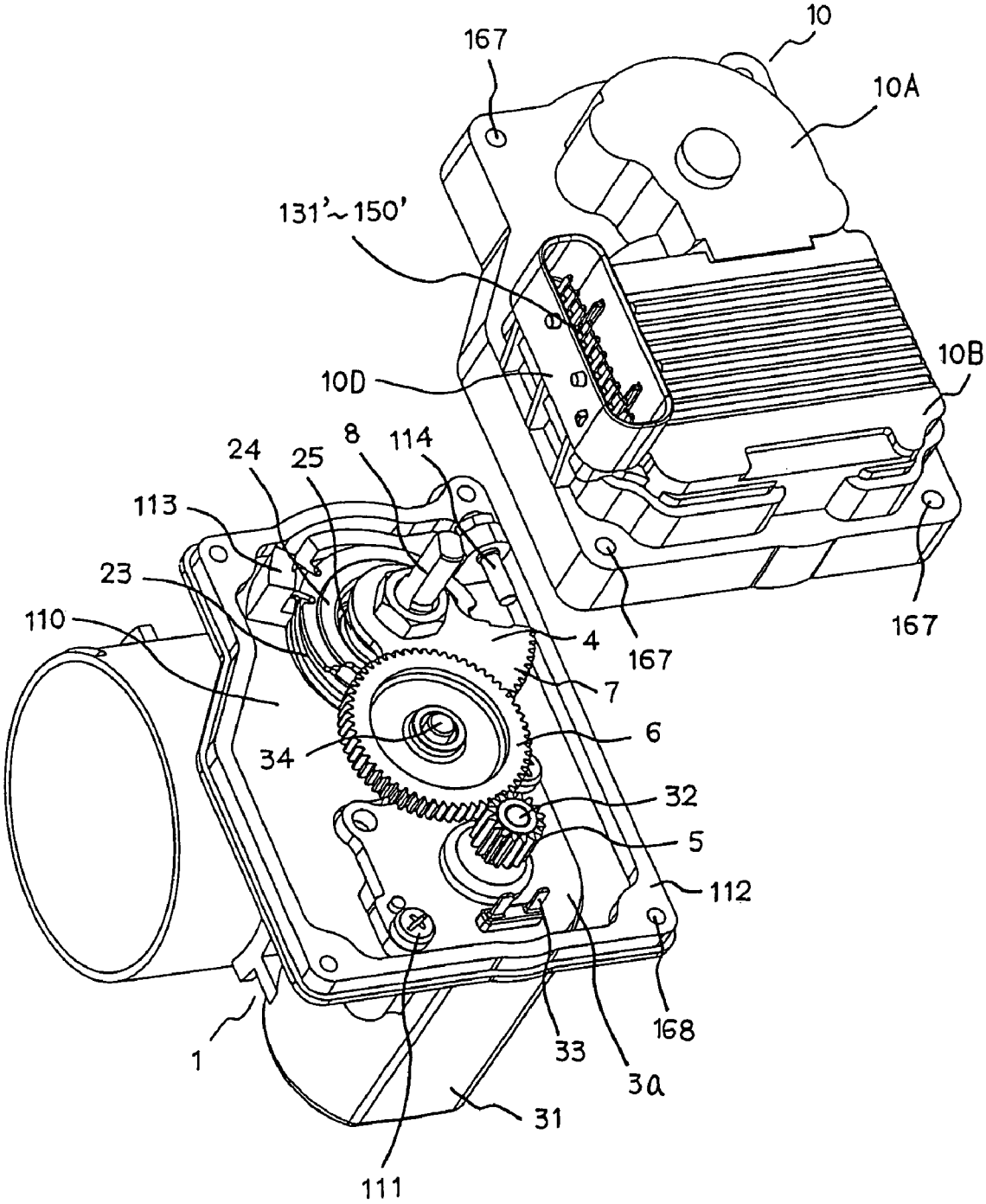
FIG. 8 is a perspective view viewing a throttle apparatus according to a second embodiment of the invention by removing a cover from a throttle body.

FIG. 8 is a perspective view viewed by removing the cover 10 from the throttle body 1 of the embodiment.

The cover 10 is attached to cover a containing portion 110 of a throttle valve mechanism formed at a side wall of the body 1, in order to protect throttle valve related parts such as the throttle valve shaft 8, the reduction gear mechanism 4, the motor 3 and so on.

Figure 13:
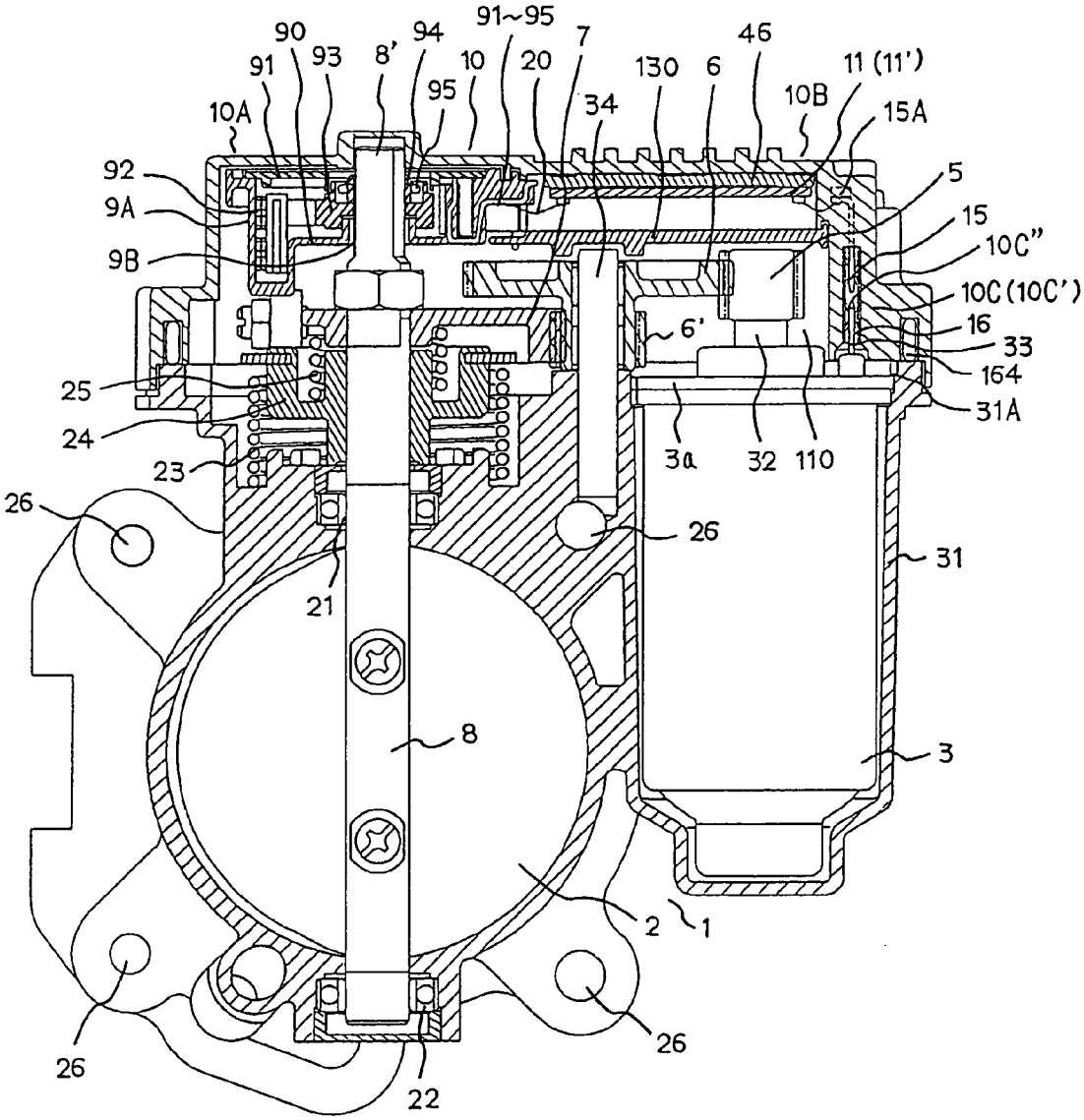
FIG. 13 is a sectional view taken along a line A-A of FIG. 12.
Figure 14:
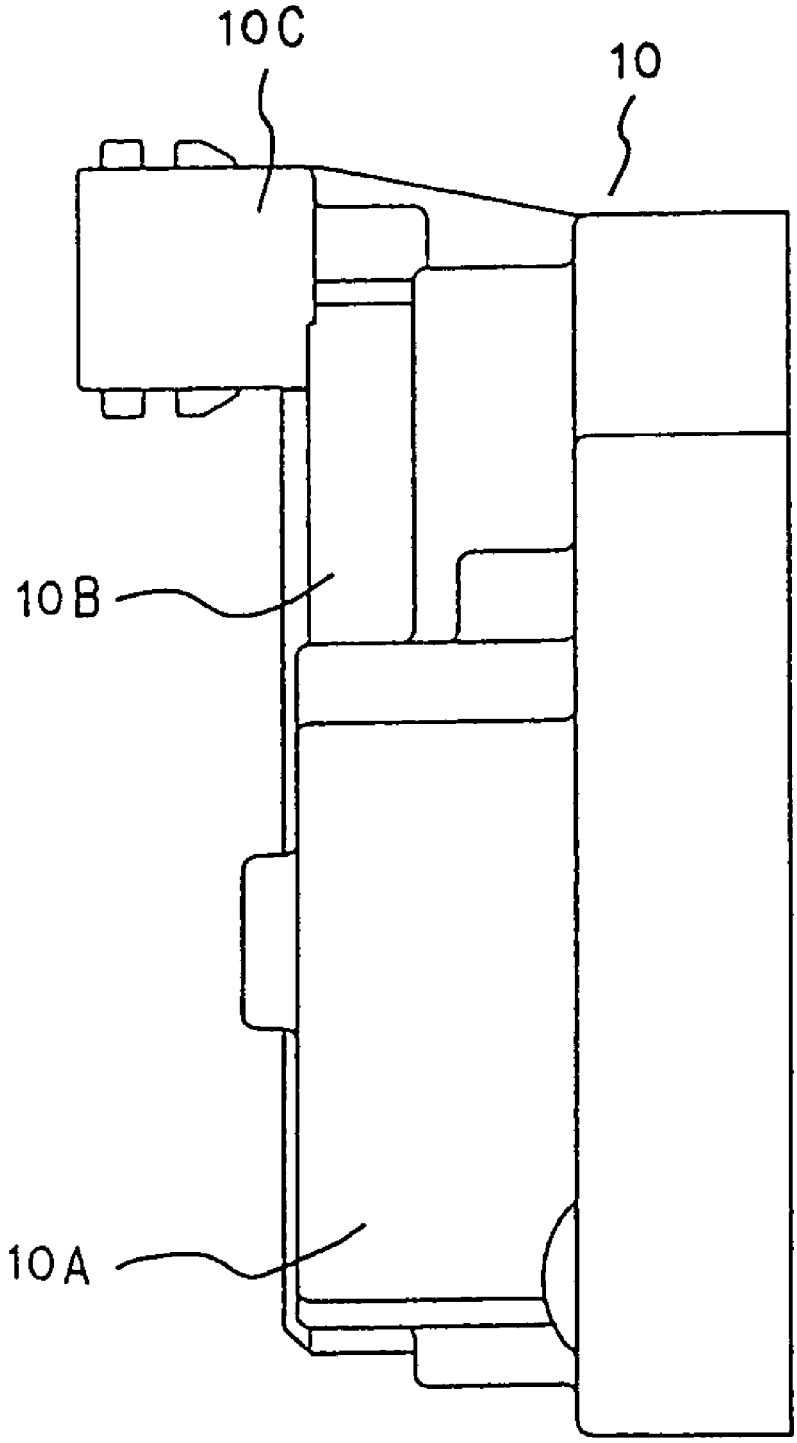
FIG. 14 is a side view of the cover.

That is, the motor (throttle actuator) 3 and the gear mechanism (power transmission apparatus) 4 are arranged to be protected by the single cover 10, And with regard to the motor 3, as shown in FIG. 13, an opening of the motor housing 31 (opening for attaching motor) is formed into the throttle valve mechanism containing portion 110, and an end bracket 3*a* of the motor 3 is fixed to the opening by screws 111 (FIG. 8).

The motor terminal 33 provided at the end bracket 3*a* is arranged to direct to the side of the cover 10 at a vicinity of a side of a trim 112 in the throttle valve mechanism containing portion 110.

The motor 3 is driven in accordance with the accelerator signal related to an amount of depressing the accelerator pedal and traction signal. The power of the motor 3 is transmitted to the throttle valve shaft 8 via the gears 5, 6 and 7.

The gear 7 is fixed to the throttle valve shaft 8, and is a fan-shaped gear, and is engaged with the lever 24 which is fitted freely to throttle valve shaft 8 to attract each other via a spring B25.

A spring A23 is a return spring of the throttle valve, one end thereof is locked by a spring locking portion 113 provided at the body 1, and other end is locked by the lever 24.

These springs A23 and B25 and the lever 24 are used to constitute a so-to-speak a default opening degree setting mechanism which has already been known publicly.

The default opening degree setting mechanism is for maintaining an initial opening degree of the throttle valve to be larger than a fully close control position of the throttle valve, when an engine key is made OFF (in other words, when the electric actuator 3 does not drive). From the default opening degree position to a fully open control position, the throttle valve opening degree is determined by balance between motor power and the spring A (return spring) 25. When the throttle valve opening degree is controlled to be smaller than default opening degree, the movement of the lever 24 is restricted by a default opening degree stopper (not illustrated), and only the gear 7 and the throttle valve shaft 8 are turned round to the fully closed direction against the force of the spring B25. Notation 114 designates a fully closed stopper, and the fully close position is determined by bringing one side of the fan-shaped gear 7 into contact with said stopper 114.

An explanation will be given here of the cover 10.

A significant characteristic of the cover 10 according to the embodiment resides in that the electronic control module 11 or so-to-speak TCM 11 for controlling the throttle valve is attached to the cover 10. Therefore, there is not provided the module housing 41 as in the first embodiment.

Figure 9:
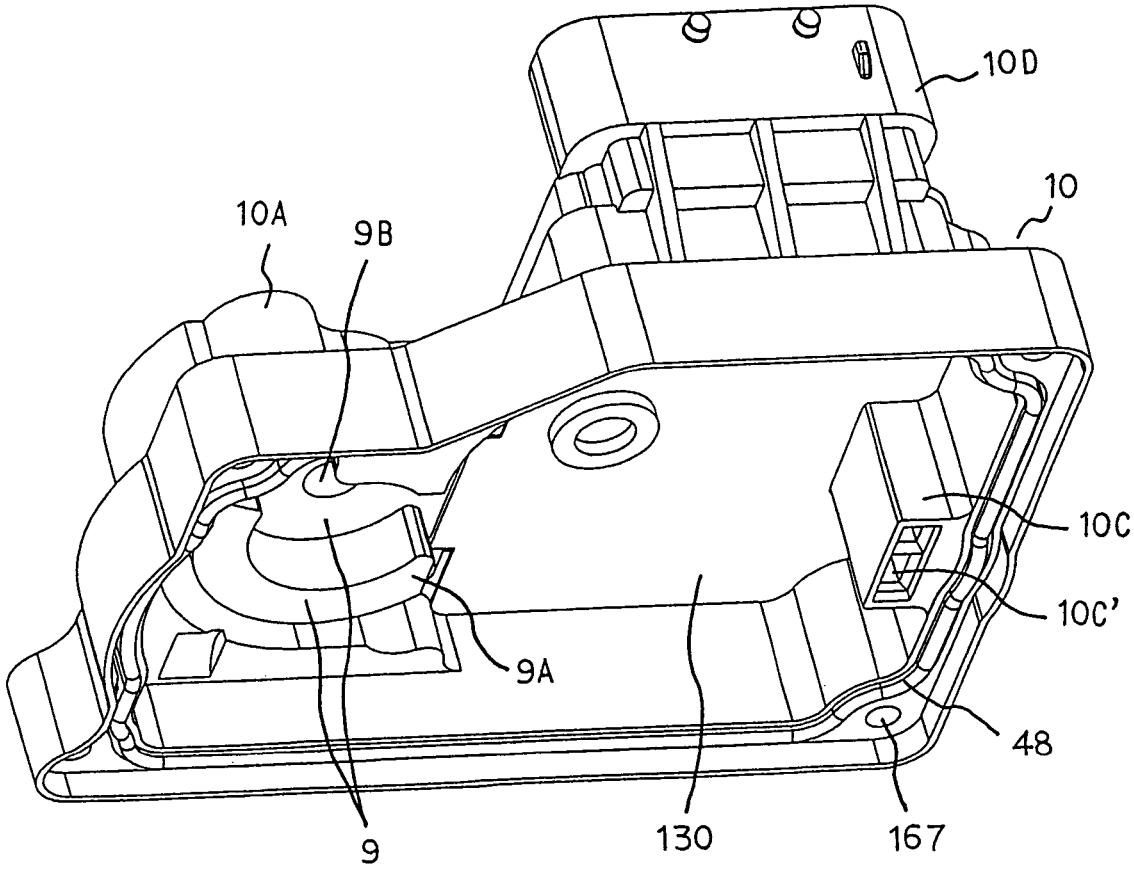
FIG. 9 is perspective view viewing the cover by changing a viewing angle.
Figure 10:
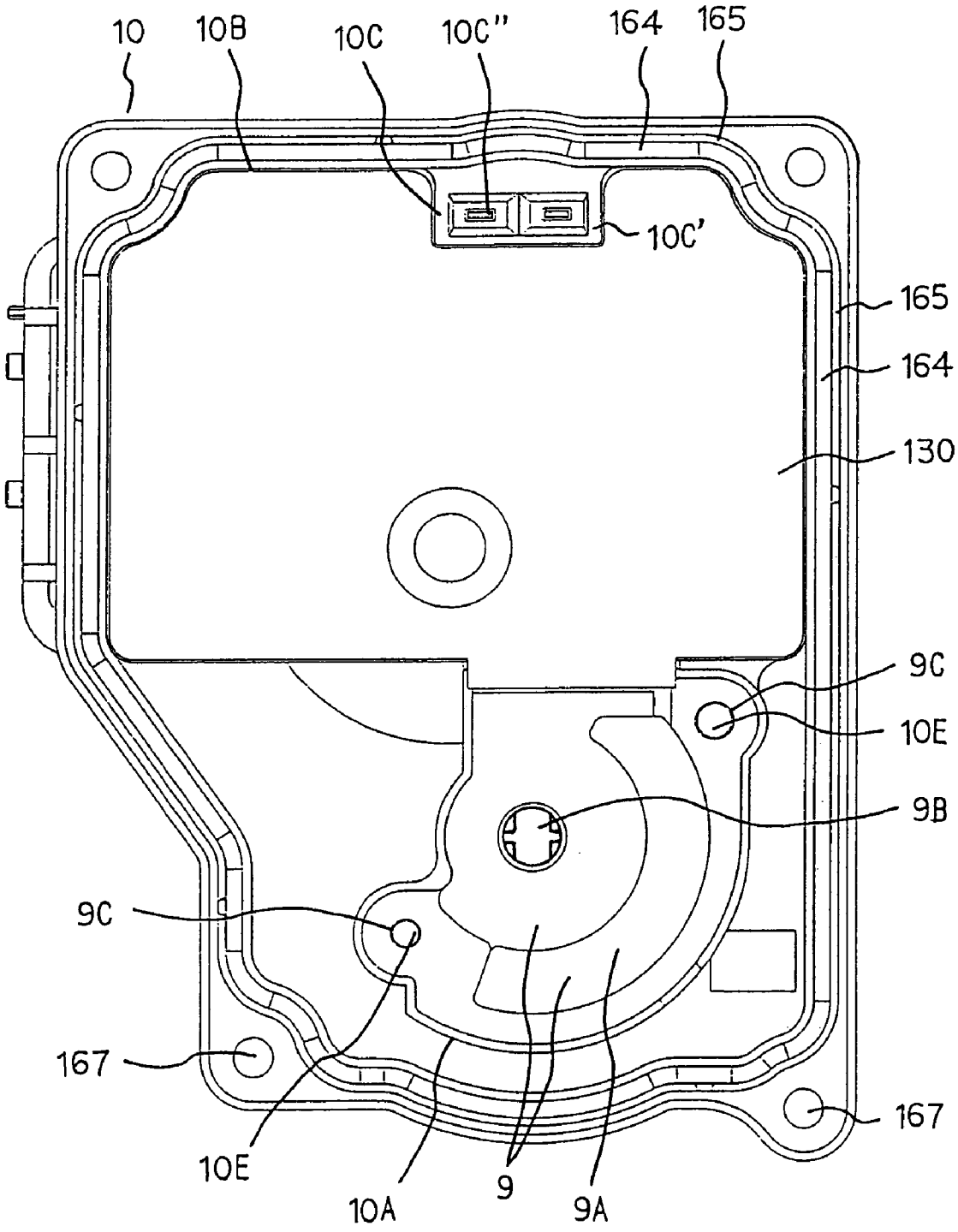
FIG. 10 is a plane view viewing the cover from an inner side.
Figure 11:
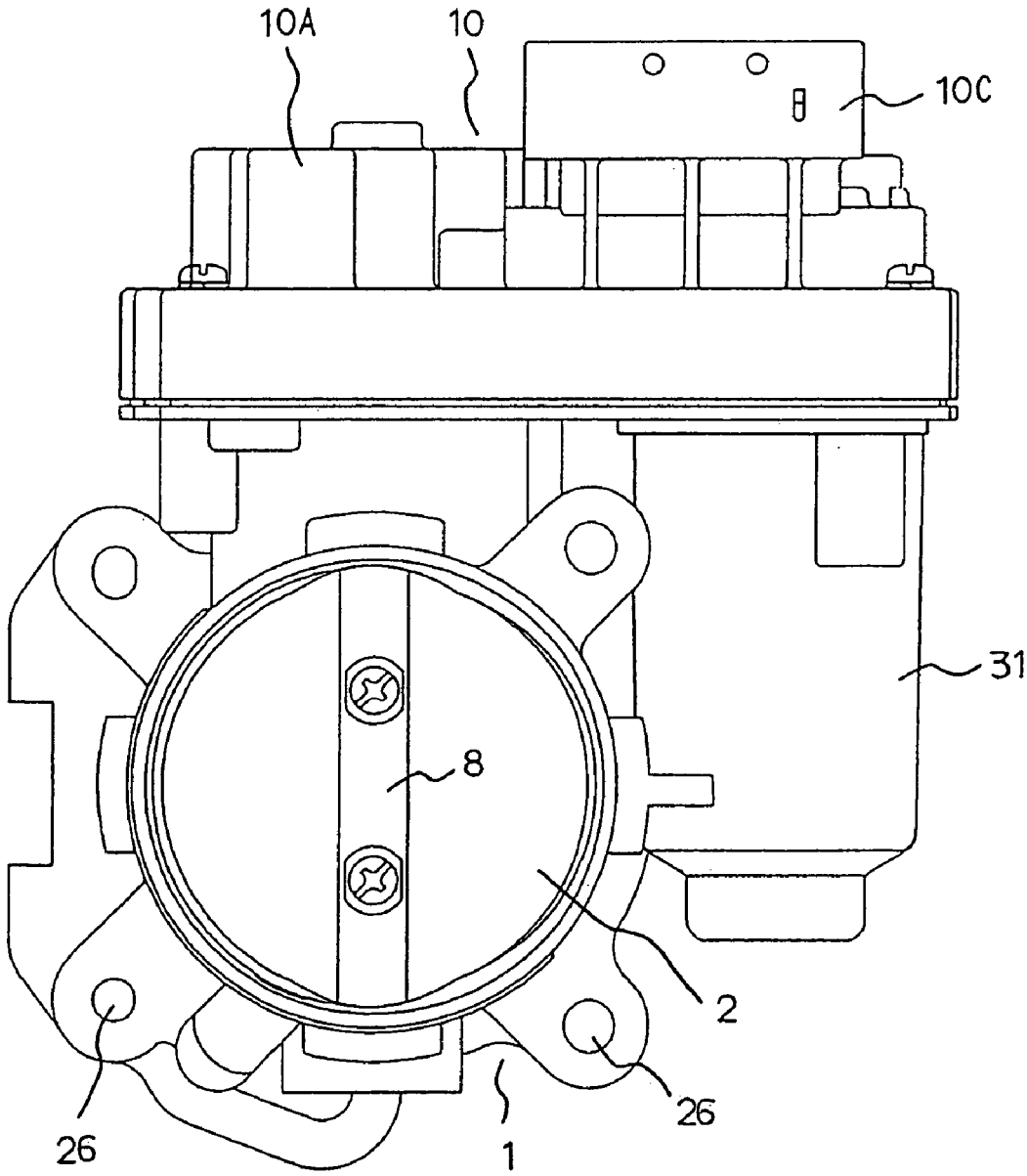
FIG. 11 is a front view of the throttle apparatus.
Figure 15:
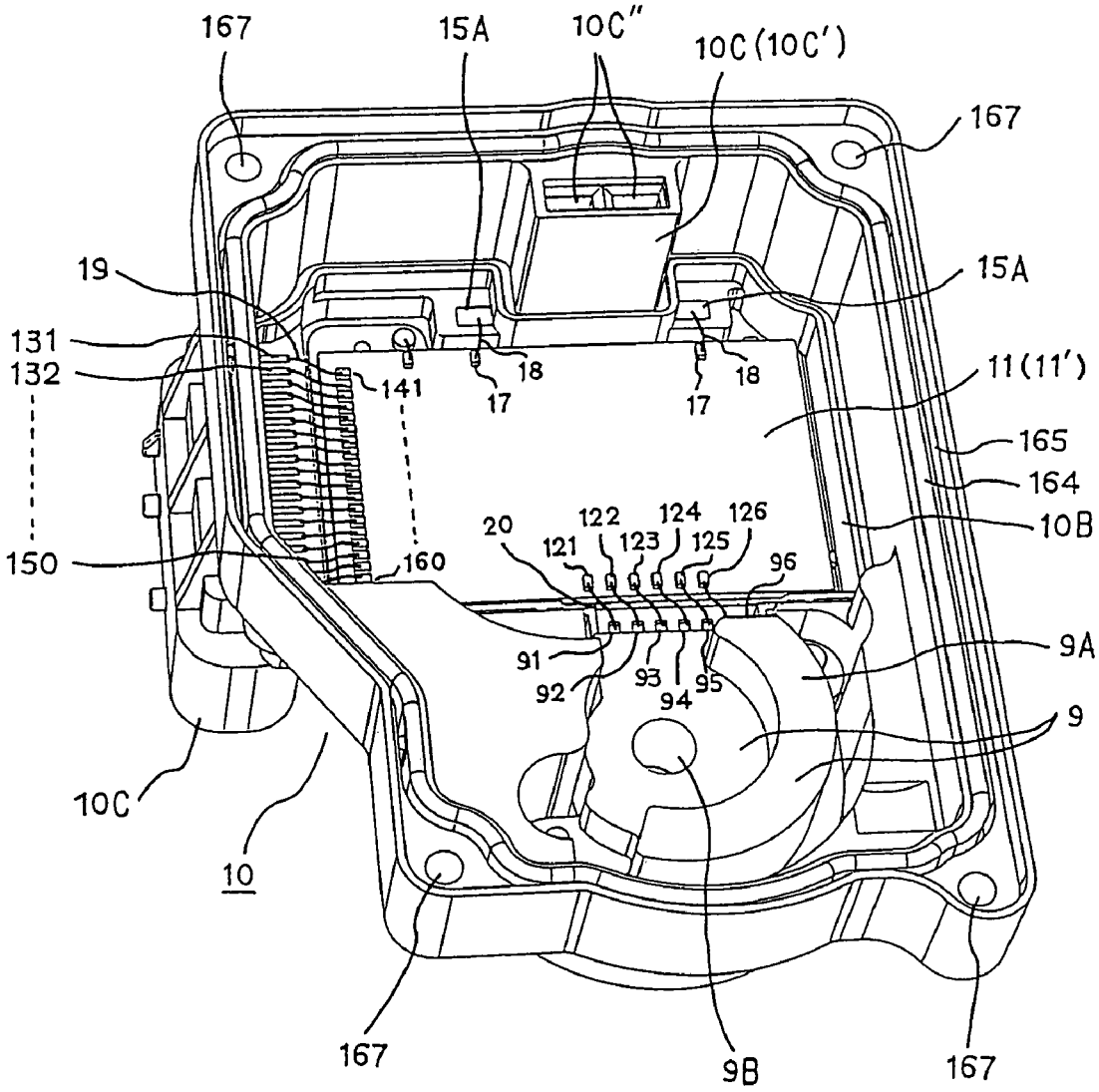
FIG. 15 is a perspective view viewing an inner side of the cover by removing a module cover.

FIG. 9 is a perspective view viewing the cover of FIG. 8 from the inner side, and FIG. 10 is a plane view viewing the cover of FIG. 8 from the inner side. In these drawings, the electronic control module 11 is not seen by being covered by a module cover 130, however, when the module cover 130 is removed, as shown in FIG. 15, at the inner face of the cover 10, the electronic control module 11 is seen attached in a containing portion 10B thereof. Further, at the inner face of the cover 10, the throttle position sensor 9 is attached contiguous to the electronic control module 11.

Terminals 91 through 96 of the throttle position sensor 9 are directed to one side of the electronic control module 11, and connected to terminals 121 through 126 of the electronic control module. The throttle position sensor of the embodiment is constituted by sensors of a double system as has been described above. Numerals 91 through 93 designate a ground terminal, an input terminal and an output terminal of one system. And numerals 94 through 96 designate a ground terminal, an input terminal and an output terminal of other system.

Figure 17:
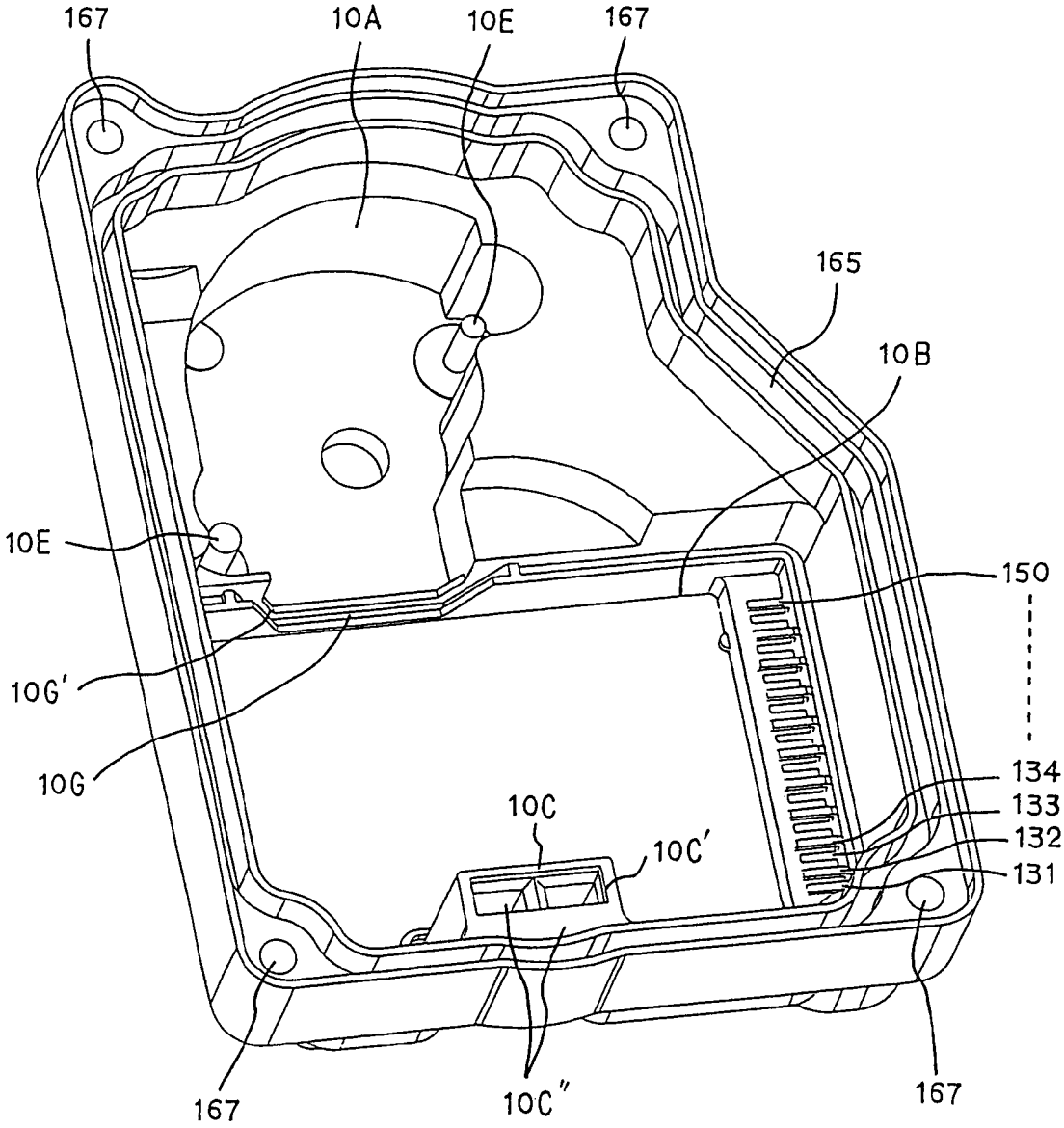
FIG. 17 is a perspective view viewing the inner side of the cover by removing a throttle position sensor and an electronic control module.

FIG. 17 is a perspective view showing the structure of the inner face of the cover 10 before attaching the throttle position sensor and the electronic control module. Explaining of the structure of the inner face of the cover 10, at the inner face of the cover 10, there are formed a containing portion of the throttle position sensor 9 (throttle position sensor housing) 10A, the containing portion of the electronic control module 11 (module housing) 10B and an intermediary connector portion 10C for connecting with the motor terminal 33 of the motor (electric actuator) 3. On the other hand, at an outer face of the cover 10, there is formed an external connecting connector portion 10D of the electronic control module 11.

All of the containing portions 10A, 10B and the intermediary connector portion 10C, are arranged contiguously each other in order to be contained compactly at the inner side of the cover 10. The throttle position sensor containing portion 10A is arranged on one side and the intermediary connector portion 10C is arranged on other side by interposing the module containing portion 10B.

The intermediary connector portion 10C is constituted by molding a connector housing 10C' at an inner face of a side wall of one side of the cover 10 integrally with the cover and insert-molding a terminal 15 (refer to FIG. 13) for motor connection in the connector housing 10C' by, One end of the terminal 15 is disposed at a terminal insertion hole 10C" and is connected to the motor terminal 33 via an intermediary metal piece 16 (FIG. 13, FIG. 19) inserted into the hole 10C", when the cover 10 is attached to the throttle body 1.

Figure 16:
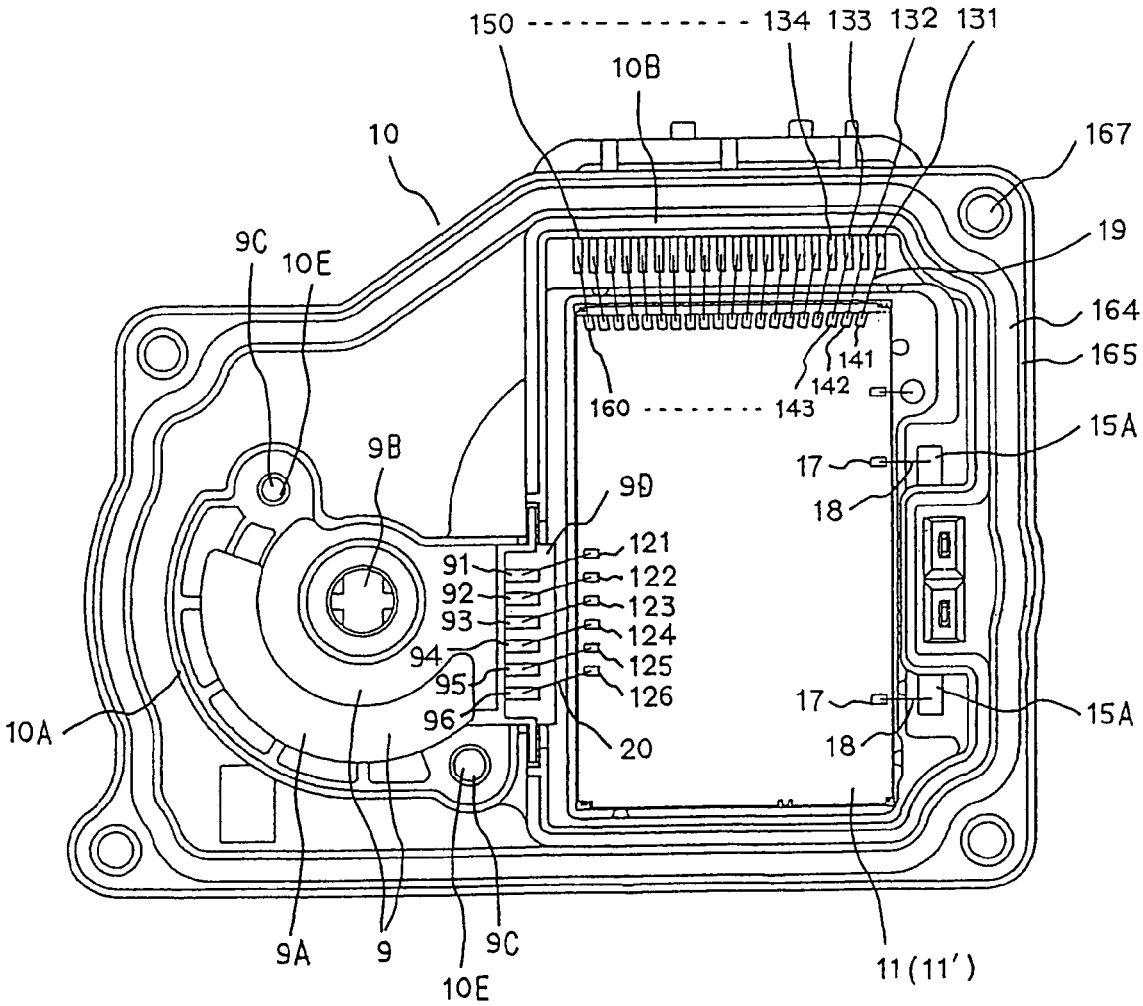
FIG. 16 is a plane view viewing the inner side of the cover by removing the module cover.

As shown in FIG. 15 and FIG. 16, other ends 15A of the terminals 15 project from left and right side faces of the connector housing 10C' to the inner portion of the cover 10, and the ends 15A and power source output terminals 17 are connected by wire bondings 18. The connection may be carried out by extending the terminals to overlap each other and directly bonding the terminals.

Further, at the cover 10 (resin mold), a group of lead frames 131 through 150 for being connected with terminals 141 through 160 of the circuit board of the electronic control module 11 is insert-molded (embedded) with an aligned arrangement.

Figure 12:
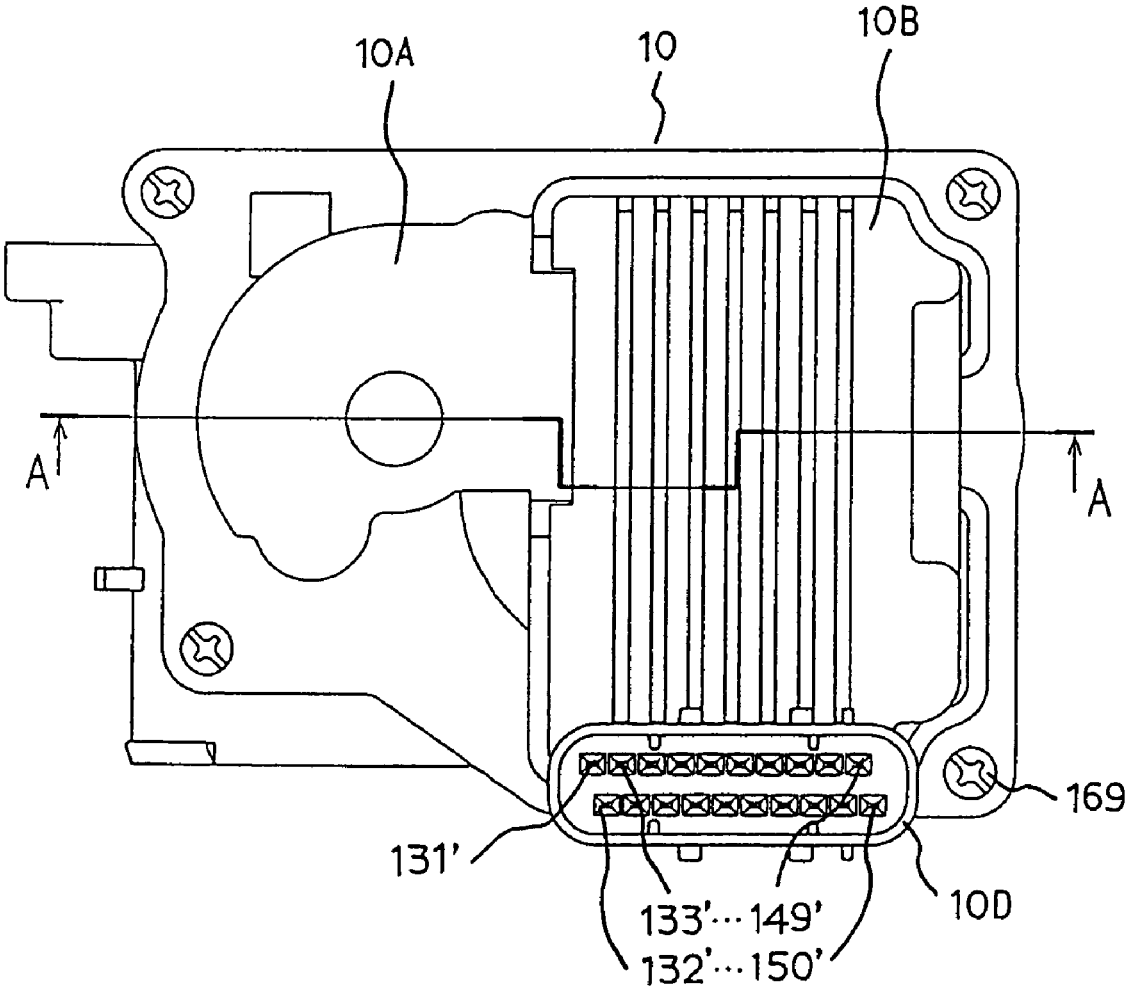
FIG. 12 is a top view of the throttle apparatus.

The ends of the lead frames on one side are exposed at positions contiguous to one side of the electronic control module containing portion 10B at the inner face of the cover 10. And as shown in FIG. 12, ends thereof on other side constitute connecter pins 131' through 150' in the outside connecting connector portion (connector case) 10D. The connector pins 131' through 150', are arranged in two rows by being divided into odd number numerals 131', 133' . . . 149' and even number numerals 132', 134' . . . 150' of notations for providing compact formation of the connector case. The lead frames 131 through 150 formed by such frame shape.

The group of terminals 131 through 150 is connected to a cable connector on the side of PCM 100. For example, the group is constituted by terminals for inputting battery power source, ground thereof, output signals from PCM (communication input, cruise signal, vehicle speed signal, accelerator pedal signal, etc.) and terminals for outputting the throttle position (valve opening degree) signal and the communication signal from TCM 11 to PCM 100.

As described above, by attaching the electronic control module 11 to the inner face of the cover 10, further, providing the connector portion 10D for external connection to the cover 10, insert-forming lead frames 131 through 150 constituting terminals thereof, further, bringing to align ends of the group of lead frames on one side along one side on the inner side of the cover, the lead frames 131 through 150 can be connected to the group of terminals 141 through 160 provided at the circuit board of the electronic control module 11 without being dotted with them in the cover.

Further, with regard to power source supply to the motor 3, power is supplied via the external connecting connector portion 10D, and the intermediary connector 10C provided at the cover 10 and the electronic control module 11. Therefore, it is not necessary to be dotted with the lead frame for power source in the cover 10, and rationalization of electric wirings (shortening and simplifying of connecting operation) can be achieved.

The throttle position sensor 9 is packaged unit style, previously completed as an assembly before integrating into the cover 10, and attached to the containing portion 10A as the unit, and accordingly attachment thereof is convenient.

As the throttle position sensor 9, an engaging hole 9B for inserting one end 8' of the throttle valve shaft is formed at a central position of the packaged unit.

Further, in order to improve positioning accuracy of the throttle position sensor 9 relative to the throttle valve shaft 8, the throttle position sensor (packaged unit) is provided with at least two pieces of positioning attaching holes 9C, meanwhile, positioning pins 10E fitted to the attaching holes 9*c* are arranged at the throttle position sensor containing portion 10A.

The positioning pins 10E are constituted by resin members integrally molded with the cover 10, and thermally welded to the attaching holes 9*c* after having been fitted thereto. Therefore, the throttle position sensor 9 is attached by so-to-speak thermal fastening.

As shown in FIG. 13, at the throttle position sensor 9, two resistors (dual resistors) 92 which constitute two potentiometers are formed on inner face of a side wall 9A of the package combined with the package elements 90 and 91. A movable conductor (rotor) 93 in contact with the resistors 92 is integrated in the package. An elastic piece 94 for receiving the one end 8' of the throttle valve shaft is arranged at the rotor center, and a ring-like spring 95 is fitted to the outer periphery of the elastic piece 94.

When the cover 10 is attached to the throttle body 1 by screws or rivets 161, the one end 8' of the throttle valve shaft is inserted into the engaging hole 9B while pushing away the elastic piece 94. The rotor 93 is engaged with the one end of the throttle valve shaft without shaky by the fastening force of the ring-like spring 95.

As shown in FIG. 17, at the inner face of the cover 10, there is formed a blocking wall 10F for partitioning between a space of the module containing portion 10B and a space of the throttle position sensor containing portion 10A. At the blocking wall 10F, there is formed a notch 10G for fitting with one end of the terminal side (terminal base) 9D of the throttle position sensor 9 (refer to FIG. 16). When the throttle position sensor 9 is set to the containing portion 10A, the terminal base 9D is fitted to the notch 10G in an airtight state. After attaching the electronic control module 11, the module containing portion 10B is charged with a gel for preventing the module from humidity. The gel is prevented from being flowed out owing to the airtight fitting of the blocking wall 10F and the terminal base 9D.

According to the embodiment, the notch 10G of the blocking wall 10F is formed with a trapezoidal-shaped fitting groove 10G' extend toward the opening.

Figure 18:
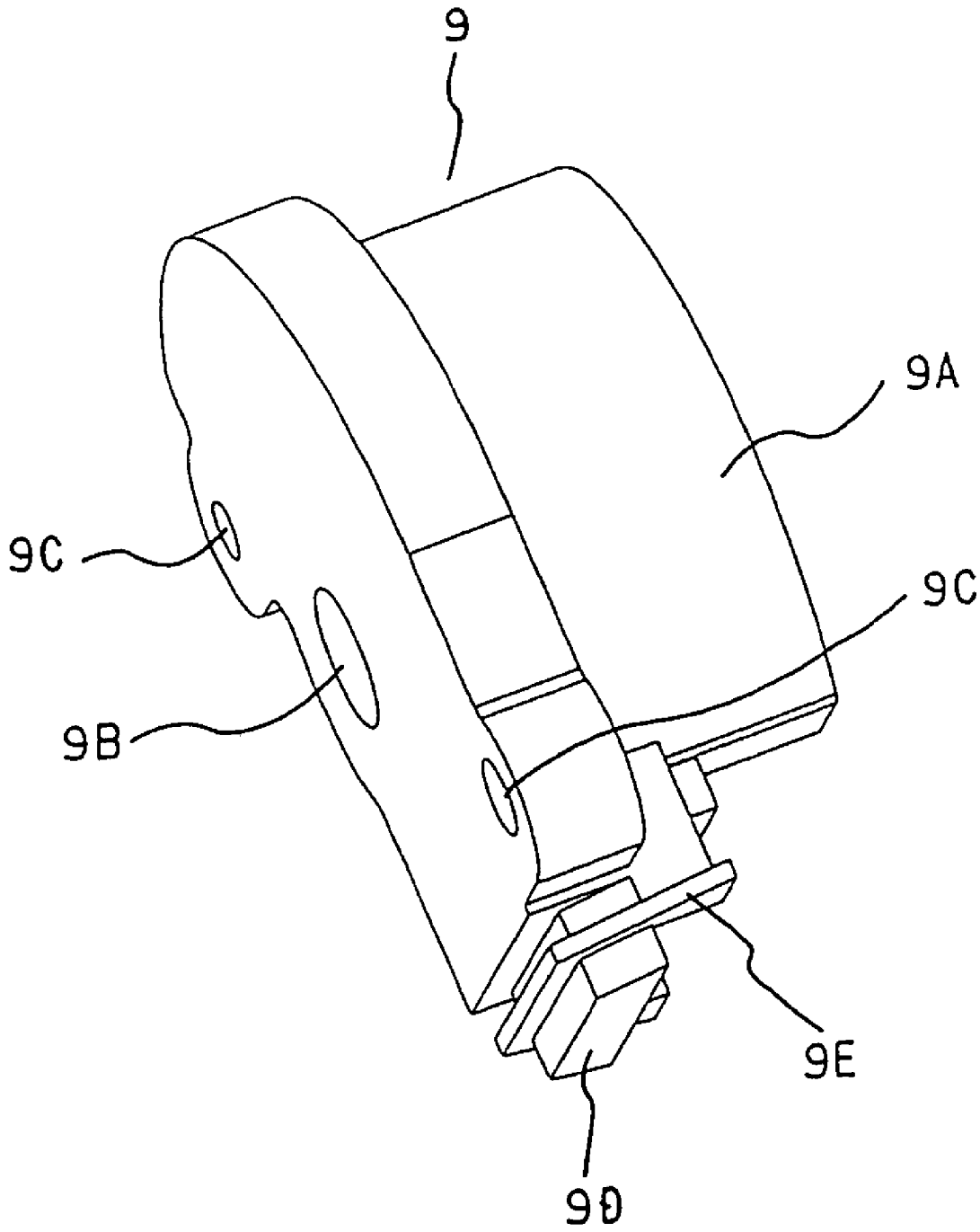
FIG. 18 is a perspective view of the throttle position sensor.
Figure 19:
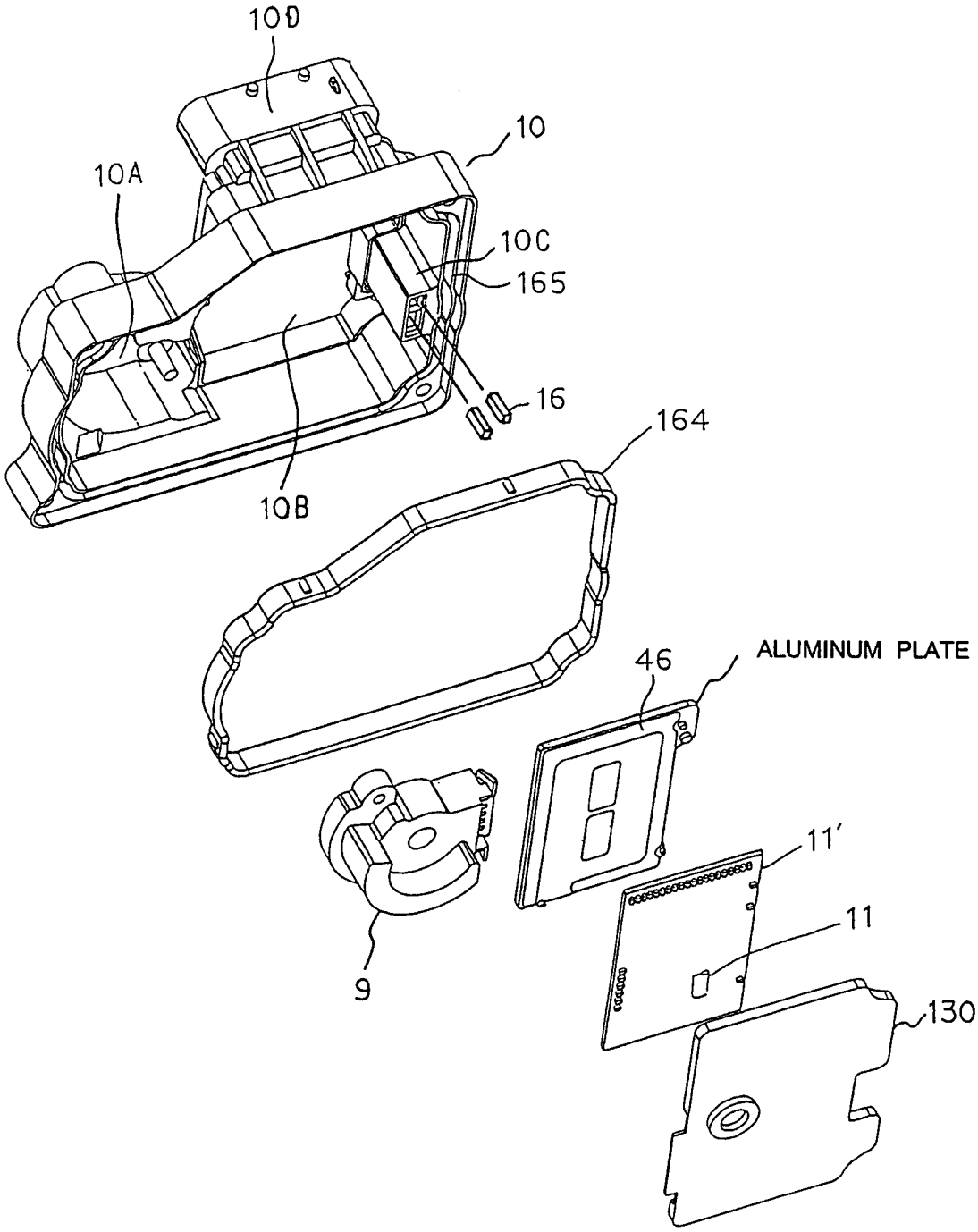
FIG. 19 is a disassembled perspective view of the cover and parts attached thereto.

AT the throttle position sensor, as shown in FIG. 18, the terminal base 9D is formed with a trapezoidal plate 9E having a shape similar to the fitting groove 10G'.

The fitting groove 10G' is fitted with the trapezoidal plate 9E by coating an adhesive agent, thereby constitute the above-described airtight fitting structure. By constituting the trapezoidal fitting structure in this way, the airtight structure is guaranteed without scraping off the adhesive agent, when the trapezoidal plate 9E is fitted to the fitting groove 10G'. Further, the hemming of the cover 10 is formed with a groove 165 fitted with a seal 164. Numeral 167 designates a cover attaching hole which is matched with a hole 168 on the side of the throttle body. The cover is fastened by a rivet or a screw as shown in numeral 169 via hole 167 and 168.

Figure 20:
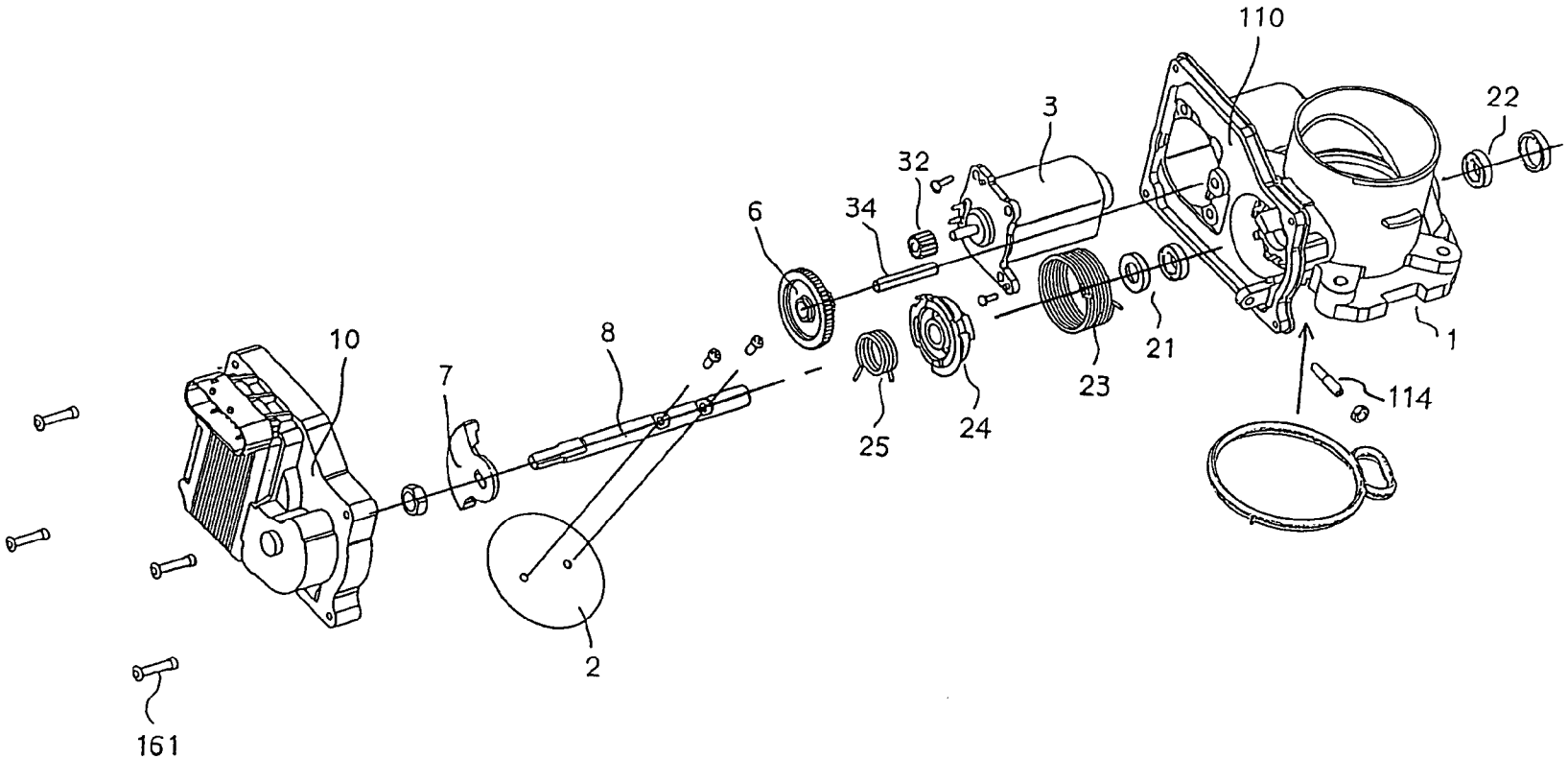
FIG. 20 is a disassembled perspective view of the throttle apparatus.

FIG. 20 is a perspective view completely disassembling the embodiment article.

According to the embodiment, there are achieved the following advantages. The throttle position sensor unit and the electronic control module can simply be attached to the cover of the throttle valve mechanism.

By only attaching the cover to the throttle body, the motor terminal and the intermediary terminal on the cover side are spontaneously connected. Further, the electronic control module and the throttle position sensor can be aggregated and attached to the throttle valve mechanism cover (space saving formation). The cover can be provided with harnesses and connectors of the electronic control module, the motor power source, the throttle position sensor and so on in simplified formation and shortened formation. Particularly with regard to the harness, the harness can be insert-molded integrally with the resin cover, further, by achieving rationalization of an amount of the harness, a reduction in fabrication cost can be achieved.

A total of the throttle apparatus is made compact, which facilitates mounting and integration to an engine.

Further, with regard to the module cover 130, although the module cover is molded by a synthetic resin, the module cover may be made of a metal in place thereof. An embodiment thereof is shown by FIGS. 21 and 22.

According to the embodiment, in order to promote heat radiating performance of the electronic module 11 in the cover 10, the module cover 130 is made of aluminum and the following heat sink structure is adopted.

Figure 21:
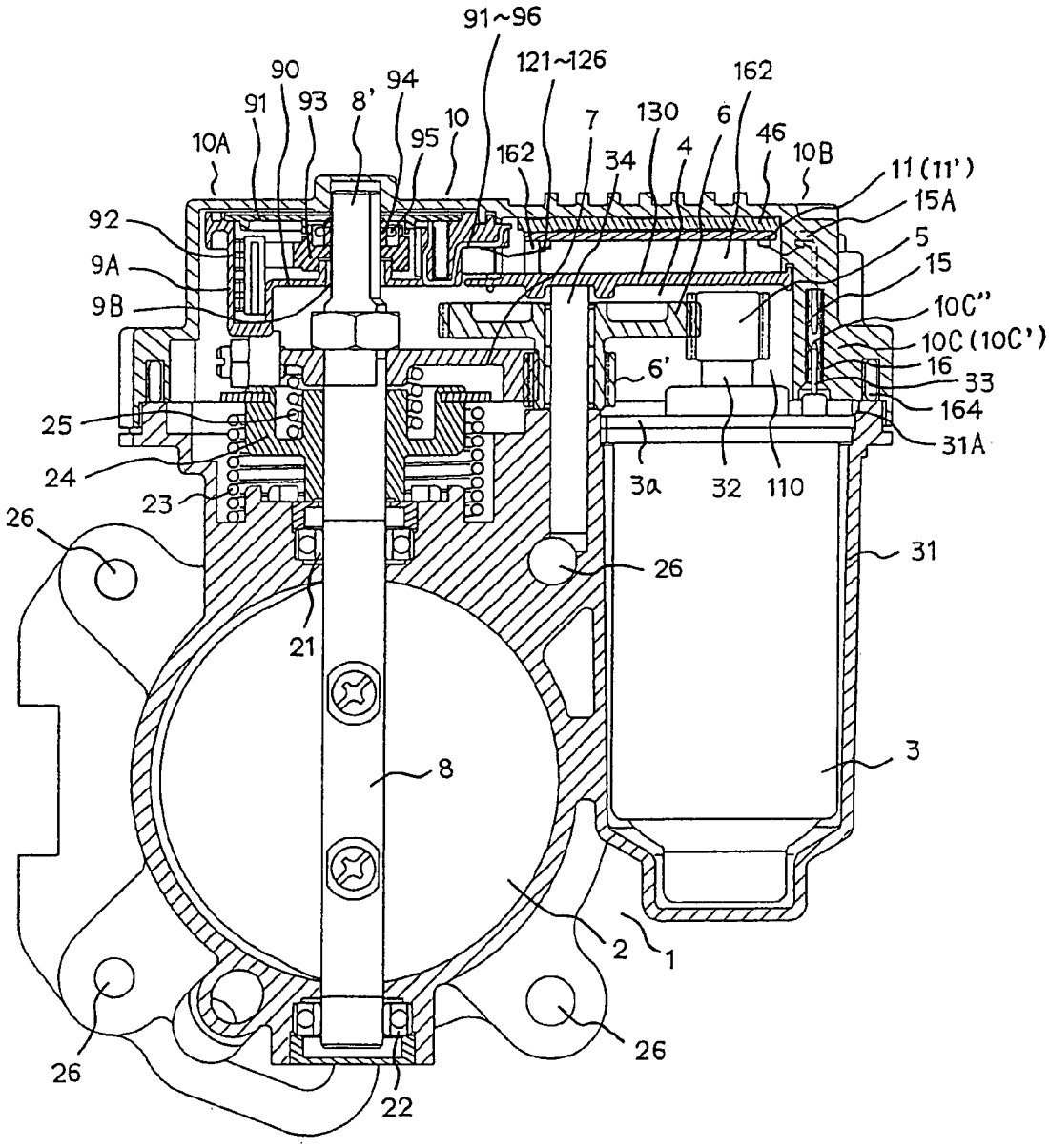
FIG. 21 is a partial sectional view of a throttle apparatus according to a third embodiment of the invention.
Figure 22:
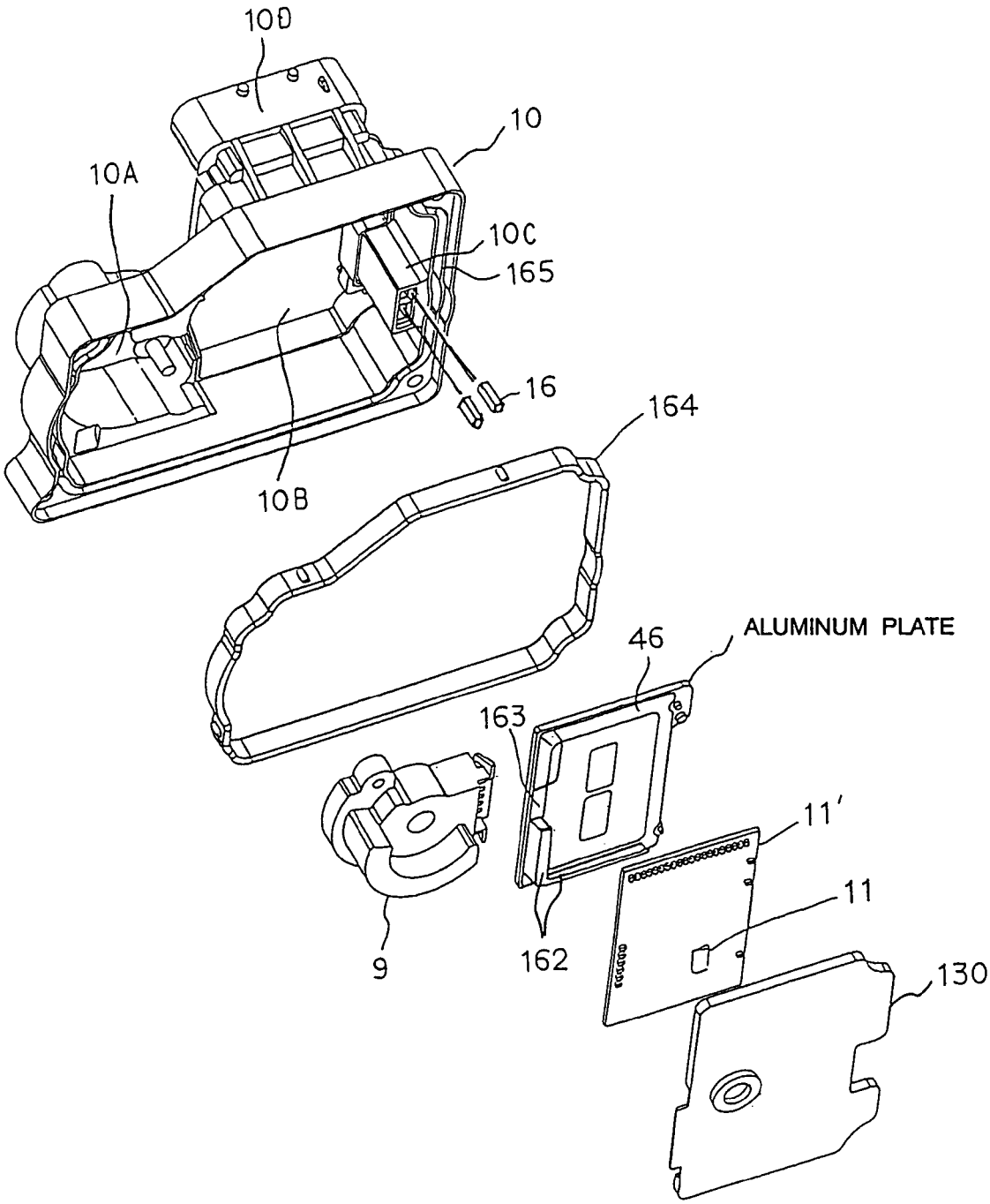
FIG. 22 is a disassembled perspective view of a cover of the throttle apparatus according to the third embodiment and parts attached thereto.

As shown in FIG. 21 and FIG. 22, the electronic control module 11 has a plate 46 for holding the circuit board 11' and the module cover 130 other than the circuit board (module main body) 11' for control. The plate 46 is molded by excellent thermally conductive material. The module cover 130 is molded by an excellent thermally conductive material and covers the circuit board 11' above the plate 46. The plate 46 and the module cover 130 are brought into contact with each other via a thermally conductive member 162. The module cover 130 is brought into contact with the throttle body 1 molded by an excellent thermally conductive material via the thermally conductive member 34.

According to the embodiment, the thermally conductive member 34 utilizes the gear shaft and is constructed by a structure in which the gear shaft 34 is brought into contact with the module cover 130 and the throttle body 1.

Further, the thermally conductive member 162 is constituted by the wall portion provided on the plate 46. Further, the throttle body 1, the plate 46, the thermally conductive member 162, the module cover 130 and the thermally conductive member 34 are made of aluminum. The thermally conductive member 162 is formed with the above-described notch 163 for receiving the terminal base of the throttle position sensor 9.

According to the embodiment, other than achieving an effect similar to that of the second embodiment, in the motor driving type throttle apparatus by giving a consideration to the heat radiating performance of the electronic control module mounted to the cover of the throttle body, the reliability of the apparatus can be promoted.

INDUSTRIAL FIELD OF UTILIZATION

As described above, according to the invention, in the motor driving type throttle apparatus, by compact formation of shape including the body and the cover, simplified formation of assembling operation, simplified formation of wiring operation substantially capable of omitting external wiring, a reduction in harness amount can be achieved and by promotion of the heat radiating performance, low cost formation of a total of the apparatus, promotion of reliability and mountability and space saving formation can be achieved.

What is claimed is:

1. A motor drive type throttle valve apparatus for an internal combustion engine, comprising:

a gear mechanism for transmitting torque of a motor to a throttle shaft of a throttle valve;

a throttle position sensor for sensing a rotational angle of said throttle shaft, and which is attached on a body of said throttle valve apparatus;

a resin cover integrated with said throttle position sensor so that said resin cover, together with said throttle position sensor, covers said gear mechanism, and attached on said body of said throttle valve apparatus;

a control circuit unit mounted in said resin cover and electrically connected with said throttle position sensor and said motor; and a connector for electrically connecting between said control circuit unit and an external unit, and which is integrally molded with said resin cover.

2. The apparatus according to claim 1, wherein said control circuit unit is formed in the shape of quadrangle; one side thereof is adjacent to said throttle position sensor; another side thereof opposite to said one side is adjacent to terminals of said motor; and said connector is arranged at the same side with anyone of other sides thereof.

3. The apparatus according to claim 1, wherein a plurality of terminals in said connector are arranged in two rows.

4. The apparatus according to claim 2, wherein said resin cover has a quadrangular flame for housing said quadrangular control circuit unit;

the first wire bonding group for connecting terminals of said connector and the first terminals of said control circuit unit, the second wire bonding group for connecting terminals of said throttle position sensor and the second terminals of said control circuit unit, and the third wire bonding group for connecting terminals of said motor and the third terminals of said control circuit unit, are laid across said frame.

* * * * *